US009259657B2

(12) United States Patent
Vatcher et al.

(10) Patent No.: US 9,259,657 B2
(45) Date of Patent: Feb. 16, 2016

(54) MOTION SIMULATION SYSTEM AND ASSOCIATED METHODS

(71) Applicant: Dynamic Motion Group GmbH, Vienna (AT)

(72) Inventors: David J. Vatcher, Longwood, FL (US); Simon A. James, Merthyr Tydfil (GB); Andrew J. Cox, Tintinhull Yeovil (GB)

(73) Assignee: Dynamic Motion Group GmbH, Vienna (AT)

( * ) Notice: Subject to any disclaimer, the term of this patent is extended or adjusted under 35 U.S.C. 154(b) by 224 days.

(21) Appl. No.: 14/094,883

(22) Filed: Dec. 3, 2013

(65) Prior Publication Data

US 2014/0157916 A1 Jun. 12, 2014

Related U.S. Application Data

(60) Provisional application No. 61/732,534, filed on Dec. 3, 2012.

(51) Int. Cl.
*A63G 31/16* (2006.01)
*A63B 69/00* (2006.01)

(52) U.S. Cl.
CPC ..... *A63G 31/16* (2013.01); *Y10T 74/18264* (2015.01)

(58) Field of Classification Search
CPC ..... A63G 19/00; A63G 19/20; A63G 31/00; A63G 31/02; A63G 31/04; A63G 31/16; A63B 69/00; G09B 9/00; G09B 9/12; G09B 9/16
USPC ..... 472/2, 59, 60, 130; 434/29, 55, 247
See application file for complete search history.

(56) References Cited

U.S. PATENT DOCUMENTS 2,229,201 A 1/1941 Williford et al.
3,304,628 A 2/1967 Kaplan
RE27,051 E 2/1971 Cappel
(Continued)

FOREIGN PATENT DOCUMENTS

WO 2011064560 A1 6/2011

OTHER PUBLICATIONS

International Search Report of Aug. 29, 2014 for International Application No. PCT/US14/33364.

*Primary Examiner* — Kien Nguyen
(74) *Attorney, Agent, or Firm* — Carl M. Napolitano; GrayRobinson, P.A.

(57) ABSTRACT

A motion simulation system includes actuators having a planetary gearbox engaged with and driven by a servomotor engaged with a crank. A connector rod has a proximal end engaged with the crank of each actuator, and a distal end engaged with a top plate configured to attach to a platform assembly. A control system is operable with each electric servo motor of each actuator for delivering control for providing a simulated motion to the top plate. Control data is sent to the servomotors using a msec data send and receive rate, with internal processing within the nano-second range. Such update rates coupled with a real time, dynamically responsive motion controller results in a desirably smooth and accurate simulator motion. The control system includes a washout filter for transforming input forces and rotational movements. One to six degrees of freedom systems having smooth performance with high payload capability are provided.

18 Claims, 26 Drawing Sheets

(56) References Cited

U.S. PATENT DOCUMENTS

| | | | | |
|---|---|---|---|---|
| 3,559,936 | A | 2/1971 | Guyon | |
| 3,577,659 | A | 5/1971 | Kail | |
| 3,967,387 | A | 7/1976 | Marchegiani | |
| 4,343,610 | A | 8/1982 | Chou | |
| 5,050,086 | A | 9/1991 | Lambregts | |
| 5,179,525 | A | 1/1993 | Griffis et al. | |
| 5,417,615 | A | 5/1995 | Beard | |
| 5,431,569 | A | 7/1995 | Simpkins et al. | |
| 5,584,697 | A | 12/1996 | Trumbull | |
| 5,656,905 | A | 8/1997 | Tsai | |
| 5,752,008 | A | 5/1998 | Bowling | |
| 5,752,834 | A | 5/1998 | Ling | |
| 5,791,903 | A | 8/1998 | Feuer et al. | |
| 5,827,065 | A | 10/1998 | Mcclintic | |
| 5,880,956 | A | 3/1999 | Graf | |
| 5,964,666 | A | 10/1999 | Uemura | |
| 6,027,342 | A | 2/2000 | Brown | |
| 6,431,872 | B1 | 8/2002 | Shiraishi et al. | |
| 6,431,989 | B1 | 8/2002 | Katayama et al. | |
| 6,435,995 | B1 | 8/2002 | Salgo | |
| 6,445,960 | B1 * | 9/2002 | Borta | G09B 9/02 434/30 |
| 6,629,895 | B2 | 10/2003 | Uemura et al. | |
| 6,634,885 | B2 * | 10/2003 | Hodgetts | G09B 9/12 434/29 |
| 6,733,293 | B2 * | 5/2004 | Baker | G09B 19/16 434/55 |
| 7,484,460 | B2 | 2/2009 | Blum et al. | |
| 7,806,697 | B2 | 10/2010 | Mallaci et al. | |
| 7,922,594 | B2 | 4/2011 | Verl et al. | |
| 7,967,688 | B2 | 6/2011 | Lai et al. | |
| 8,201,467 | B2 | 6/2012 | Johnson et al. | |
| 8,395,335 | B2 | 3/2013 | Marchand et al. | |
| 8,444,496 | B2 | 5/2013 | Lai et al. | |
| 2001/0029011 | A1 | 10/2001 | Dagani et al. | |
| 2002/0116078 | A1 | 8/2002 | Lee et al. | |
| 2003/0224333 | A1 | 12/2003 | Vastvedt | |
| 2004/0160415 | A1 | 8/2004 | Rosenberg et al. | |
| 2004/0181380 | A1 | 9/2004 | Yoshida et al. | |
| 2007/0134637 | A1 | 6/2007 | Bronstein et al. | |
| 2007/0218427 | A1 | 9/2007 | Lefton | |
| 2007/0269771 | A1 | 11/2007 | Lefton | |
| 2007/0299642 | A1 | 12/2007 | Kondo | |
| 2008/0286726 | A1 | 11/2008 | Bennett | |
| 2009/0163283 | A1 | 6/2009 | Childress | |
| 2010/0032543 | A1 | 2/2010 | Van Der et al. | |
| 2010/0070248 | A1 | 3/2010 | Morali et al. | |
| 2010/0092267 | A1 | 4/2010 | Najdovski et al. | |
| 2010/0100365 | A1 | 4/2010 | Moriyama | |
| 2010/0131865 | A1 | 5/2010 | Ackley et al. | |
| 2010/0228396 | A1 | 9/2010 | Pechev | |
| 2010/0279255 | A1 | 11/2010 | Williams | |
| 2010/0302258 | A1 | 12/2010 | Epps et al. | |
| 2011/0070564 | A2 | 3/2011 | Van Biervliet | |
| 2011/0087474 | A1 | 4/2011 | Paulsen et al. | |
| 2011/0093250 | A1 | 4/2011 | Lin | |
| 2011/0177873 | A1 | 7/2011 | Sebelia et al. | |
| 2012/0029703 | A1 | 2/2012 | Veltena | |
| 2013/0018374 | A1 | 1/2013 | Edelhauser et al. | |
| 2013/0045812 | A1 | 2/2013 | Garner | |

* cited by examiner

| | 16a | 16b | 16c | 16d | 16e | 16f |
|---|---|---|---|---|---|---|
| ACTUATOR (10) | ACTUATOR 1 | ACTUATOR 2 | ACTUATOR 3 | ACTUATOR 4 | ACTUATOR 5 | ACTUATOR 6 |
| ACTUATOR LOCATION | FRONT LEFT | MIDDLE LEFT | REAR LEFT | REAR RIGHT | MIDDLE RIGHT | FRONT RIGHT |
| ACTUATOR COLOUR | BLUE | RED | MAGENTA | GREEN | YELLOW | CYAN |
| | | | | | | |
| TOP DECK POSITION | - | - | - | - | - | - |
| NEUTRAL | HORIZONTAL | HORIZONTAL | HORIZONTAL | HORIZONTAL | HORIZONTAL | HORIZONTAL |
| HEAVE UP | TDC | TDC | TDC | TDC | TDC | TDC |
| HEAVE DOWN | BDC | BDC | BDC | BDC | BDC | BDC |
| PITCH NOSE UP | +30 | -20 | -30 | -30 | -30 | +30 |
| PITCH NOSE DOWN | -30 | +20 | +30 | +30 | +20 | -30 |
| ROLL LEFT SIDE UP | +27 | +36 | +32 | -15 | -33 | +02 |
| ROLL RIGHT SIDE UP | +02 | -33 | -15 | +32 | +36 | +27 |
| YAW LEFT | -25 | +15 | -25 | +15 | -25 | +15 |
| YAW RIGHT | +25 | -15 | +25 | -15 | +25 | -15 |
| SURGE FORWARD | +32 | -14 | +38 | +38 | -14 | +32 |
| SURGE BACKWARD | +38 | +14 | +32 | +32 | +14 | +38 |
| SWAY LEFT | +37 | +21 | -14 | +29 | +04 | -10 |
| SWAY RIGHT | -10 | +04 | +29 | -14 | +21 | +37 |

FIG. 14

FRONT - UP
RIGHT - DOWN
LEFT - DOWN

FRONT - DOWN
RIGHT - DOWN
LEFT - DOWN

FRONT - DOWN
RIGHT - UP
LEFT - UP

FRONT - UP
RIGHT - UP
LEFT - UP

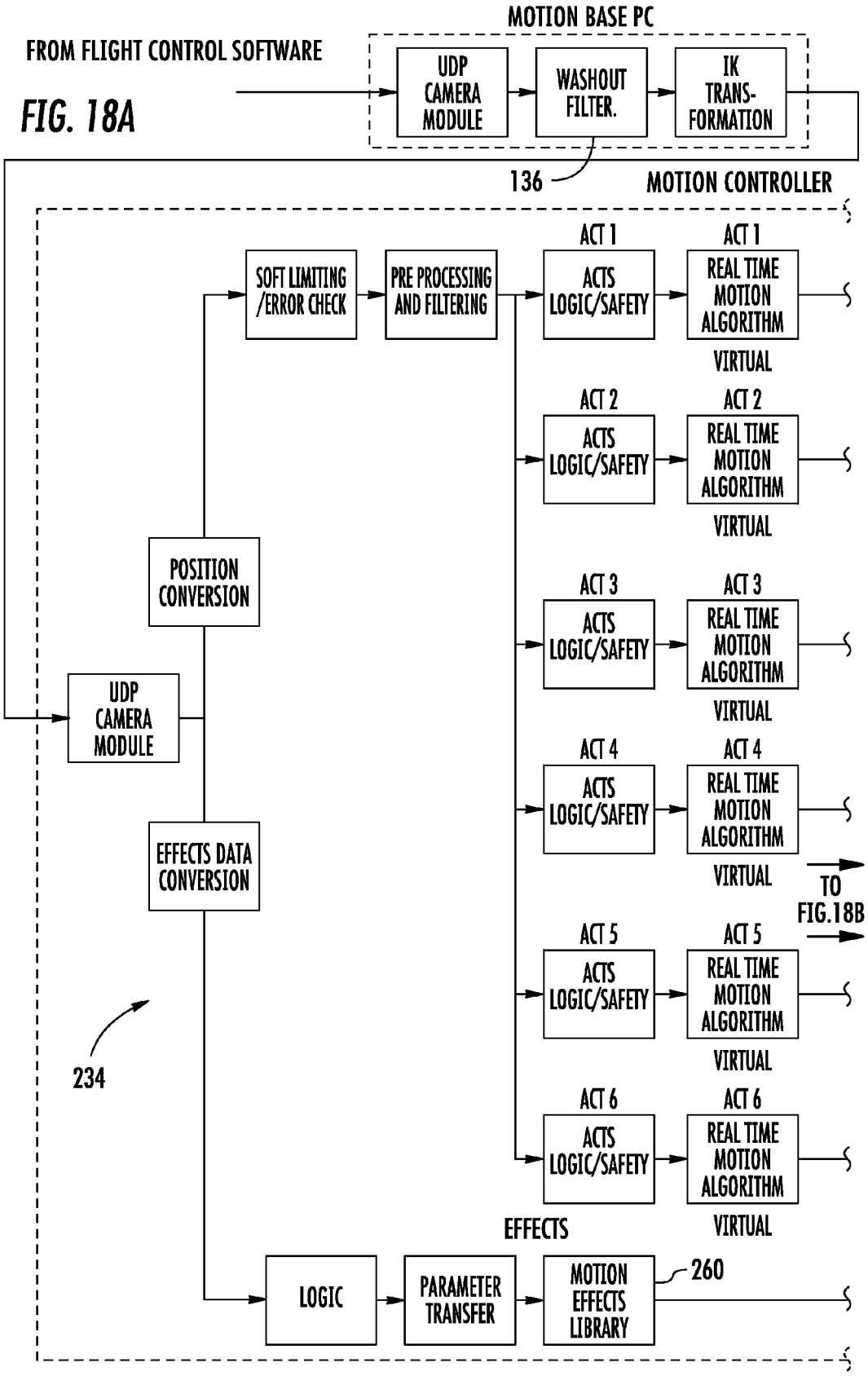
MOTION BASE PC
FROM FLIGHT CONTROL SOFTWARE
FIG. 18A
UDP CAMERA MODULE
WASHOUT FILTER.
IK TRANS-FORMATION
136
MOTION CONTROLLER
SOFT LIMITING /ERROR CHECK
PRE PROCESSING AND FILTERING
ACT 1
ACTS LOGIC/SAFETY
REAL TIME MOTION ALGORITHM
VIRTUAL
ACT 2
ACT 3
ACT 4
ACT 5
ACT 6
POSITION CONVERSION
UDP CAMERA MODULE
EFFECTS DATA CONVERSION
TO FIG.18B
234
EFFECTS
LOGIC
PARAMETER TRANSFER
MOTION EFFECTS LIBRARY
260

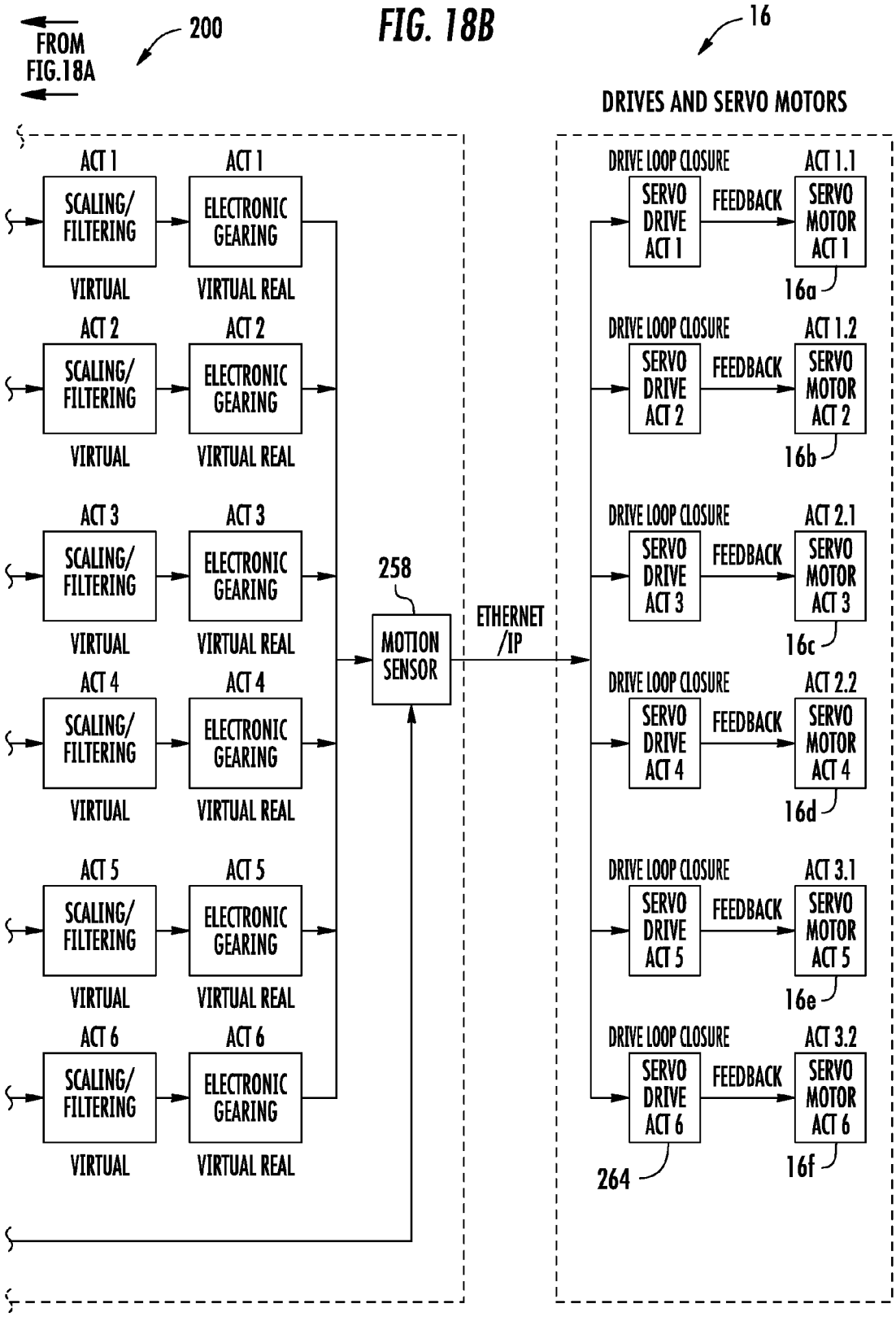
FIG. 18B
FROM FIG.18A
200
16
DRIVES AND SERVO MOTORS
ACT 1
SCALING/ FILTERING
VIRTUAL
ELECTRONIC GEARING
VIRTUAL REAL
ACT 2
ACT 3
ACT 4
ACT 5
ACT 6
258
MOTION SENSOR
ETHERNET /IP
DRIVE LOOP CLOSURE
SERVO DRIVE ACT 1
FEEDBACK
SERVO MOTOR ACT 1
ACT 1.1
16a
SERVO DRIVE ACT 2
SERVO MOTOR ACT 2
ACT 1.2
16b
SERVO DRIVE ACT 3
SERVO MOTOR ACT 3
ACT 2.1
16c
SERVO DRIVE ACT 4
SERVO MOTOR ACT 4
ACT 2.2
16d
SERVO DRIVE ACT 5
SERVO MOTOR ACT 5
ACT 3.1
16e
SERVO DRIVE ACT 6
SERVO MOTOR ACT 6
ACT 3.2
16f
264

MOTION SIMULATION SYSTEM AND ASSOCIATED METHODS

CROSS-REFERENCE TO RELATED APPLICATION

This application claims the benefit of U.S. Provisional Application Ser. No. 61/732,534, having filing date of Dec. 3, 2012 the disclosure of which is hereby incorporated by reference in its entirety and all commonly owned.

FIELD OF THE INVENTION

The present invention generally relates to motion simulation and in particular to motion system platforms and controls thereof.

BACKGROUND

Motion simulation systems have included platforms for supporting and initiating physical movement for participants in film exhibitions and amusement attractions as well as simulation products. Such systems have been designed to provide physical movement to participants with film or computer simulation activities.

Motion simulators such those as for amusement attractions and flight simulators include a system that artificially recreates motions such as aircraft flight and various aspects of a flight environment. Typically, these systems include software operated algorithms that govern how a vehicle moves such as in aircraft flight, and how the vehicle reacts to vehicle controls and to external environmental factors such as air density, turbulence, and the like. By way of example, flight simulation is used for a variety of reasons, including flight training for pilots, design and development of the aircraft itself, and research regarding aircraft characteristics and control handling qualities. Further, flight simulations may employ various types of hardware, modeling detail and realism. Systems may include PC laptop-based models of a simple cockpit replica to more complex cockpit simulations, and with wide-field outside-world visual systems, all mounted on six degrees-of-freedom (DOF) motion platforms which move in response to pilot control movements and external aerodynamic factors. Yet further, six axes motion systems have been used for simulation in driver training.

Early motion systems typically gave movements in pitch, roll and yaw, and the payload was limited. The use of digital computers for flight simulation typically was limited to specialist high-end computer manufacturers, but with the increasing power of the PC, arrays of high-end PCs are now also used as the primary computing medium in flight simulators.

The early models generally used TV screens in front of the replica cockpit to display an Out-The-Window (OTW) visual scene. Computer-based image generator systems also used TV screens and sometimes projected displays including collimated high end displays for pilot training.

As improvements to motion simulator systems developed with advances in technology, demand increased for full flight simulators (FFS) to duplicate relevant aspects of the aircraft and its environment, including motion. A six degrees-of-freedom (DOF) motion platform using six jacks is a modern standard, and is required for Level D flight simulator standard of civil aviation regulatory authorities such as the Federal Aviation Administration (FAA) in the US and the European Aviation Safety Agency (EASA) Europe. The FAA FFS Level D requirements are the highest level of FFS qualification currently available. The motion platform must have all six degrees of freedom, and the visual system must have an outside-world horizontal field of view of at least 150 degrees, with a collimated distant focus display and with a transport delay to conform to the FAA FFS Level D requirements. Realistic sounds in the cockpit are required, as well as a number of special motion and visual effects.

In order for a user to feel that a motion simulator is accurate, the simulator has to behave in a way that feels realistic and predictable. By way of example, if a pilot gently guides a simulated aircraft into a turn, the motion simulator shouldn't tilt at a sharp angle, which would represent a much tighter turn. Data gathered from computer models, field tests and complex algorithms are typically used to program simulator behavior. Force-feedback greatly affects the user's experience, making it seem more real and consequently a more effective training environment.

Cam driven motion systems have been used in products for the amusement and for low-end simulation in the simulation industries. Cam driven systems have been provided with a variety of geometries and axis arrangements, including 3-Axis systems and six-axis systems, such as used by E2M Technologies in the Netherlands.

Certain of these systems have used induction motors controlled by variable speed drives (VSDs) using analogue control signals from a motion controller based on a PID loop. A Proportional, Integral, Derivative (PID) loop is typically used by controllers to eliminate the need for continuous operator attention. These induction motor systems experience problems with motion lag caused by slip between the field and the rotor which results in a large error between the commanded and actual position. Further, servo motor controlled systems known in the industry have also not met the requirements for Level D. Such position errors are increasingly problematic as motion systems in simulators and amusement attractions utilize higher speed computer rendering and graphics as users can sense and experience this lag, slow response time and an out-of-sync experience.

Systems have sought to achieve multi-axis motions systems such as the Stewart platform which used a 3 to 3 and 3 to 6 configuration which was difficult to produce due to the complexity of the co-joined bearings.

Known induction motor and servo motor systems also have limitations in the control of the position of the system in relation to an activity of the user such as simulation activity like flying or viewing a film or visual depiction in a simulator. These systems also experience problems induced by activities such as high frequency vibrations that affect the life and performance of the motors. Payloads have also been limited by these designs due to the power-to-size ratios of both induction motors and servo motors with currently known control systems.

There remains a need for an improved motion simulation system with improved control of the motion and synchronization between the physical motion and response time to provide a smooth motion and realistic motion experience. There is further a need for such simulation systems to be capable of supporting a high payload while maintaining the smooth and realistic motion experience. There is also a need for a motion system that can be easily reconfigured and adjusted for varying operating scenarios or applications.

SUMMARY

An aspect of the present invention includes teachings of a motion simulation system comprising a frame, at least one connector rod having opposing proximal and distal ends thereon, wherein the distal end of the at least one connector rod is rotatably connected to the frame, and at least one actuator. The actuator may comprise a motor/gearbox assembly having a servomotor operable with a planetary gearbox and shaft driven thereby, a crank arm having a proximal end fixedly attached to the shaft for rotation thereby, and a distal end rotatably connected to the proximal end of the connector rod. Yet further, the actuator may include a base and a support having a proximal end affixed to the base and an opposing distal end affixed to the motor/gearbox assembly for fixedly attaching the motor/gearbox assembly in spaced relation to the base or foot for permitting the crank arm to make rotations about an axis of the shaft. Generally for one, two and three degree of freedom systems, full 360 degree rotations are employed, and may be made available for six degree of freedom systems. A controller may be operable with the actuator for providing an electric signal to each of the servomotors for providing a preselected motion to the at least one connector rod and thus the frame, wherein the control system directs input forces and rotational movements into positions of the frame.

One motion simulation system may comprise a foundation or base, at least one or a plurality of actuators connected to the foundation and at least one top plate movably connected with the actuators and configured to connect a platform assembly. Each of the actuators may comprise a support plate configured to connect with the foundation and having an aperture that receives a planetary gearbox. The gearbox is engaged with and driven by at least one electric servo motor and the gearbox is connected to a drive shaft. The motor and gearbox and shaft can be provided as a single unit referred to as a motor/gearbox assembly. The drive shaft is engaged with at least one main crank. A main crank is movably connected with a connector rod by bearings at a first proximal end of the connector rod. At the distal end of the connector rod, bearings are attached and connected with a top plate. A top plate may be configured to attach to the platform assembly to drive the platform assembly in use.

The motion simulation system may include a control system for controlling movement of an actuator for recreating acceleration, reducing the acceleration to zero while sending the system to a neutral position below a level of perception of a user of the simulation system, by way of example. The control system for professional training preferably includes a washout filter module used to transform input forces and rotations of the platform into positions and rotations of the motion platform so that the same forces can be reproduced using the limited motion envelope of the motion platform. This washout filter is an implementation of a classical washout filter algorithm with improvements including a forward speed based input signal shaping, extra injected position and rotation, extra injected cabin roll/pitch, and rotation center offset from the motion platform center when in the neutral position. The washout filter has two main streams including high frequency accelerations and rotations (short term and washed out), and low frequency accelerations (a gravity vector).

The control system sends signals to the electric motor to drive the actuator to and through its desired positions. For example, the control system sends signals to vary the speed of the electric motors and to move the actuator elements into a desired position by moving the crank through a path of rotation and the connector rod through one or more paths in and across multiple axis of rotation.

The motion system may utilize a single axis, or multi-axis systems including by way of example, one, two, three and six axes. The motion system components can be varied to provide these different configurations or to provide different application with the same axis structure. For example, the number, size and positioning of components may be varied by varying the number of crank arms and connector rods and planes which they rotate and work. Electric servo motors and planetary gear boxes may be provided according to the number of axes, or some multiple of the number of axes. For example, the system may be provided with two motors and two gearboxes per actuator or four motors and four gearboxes per actuator, and yet further, six motors and six gearboxes, as desired to meet performance and payload requirements, by way of example. Support plates may be provided with one per actuator while main cranks can be provided with one per actuator or two per actuator in configurations, where four motors and four gearboxes drive one actuator. Connector rods typically are provided one per actuator with two spherical bearings per actuator, one bearing at each end of the connector rod or arm member.

Configurations may comprise three axes and six axes. For example, in a six axis configuration, the motor/gearbox/driveshaft and crank arm may be placed at 90° angles. The crank arms and connector rods, by way of example, may use spherical bearings and do not work in the same plane of motion. This provides six degrees of freedom by rotation in three directions and combinations of all rotations and translations. In a two axis system, the motor/gearbox/driveshaft and crank arm may be positioned along a common line such that the crank arm and connecting rod operate in same plane. This provides two degrees of freedom, a single rotation and single translation degree. With appropriate guides, such a system can also provide a single degree of freedom, typically with translation in a heave motion.

In one embodiment of a six axis system, six actuators are equally spaced 60° apart on a nominal circular base plate. The actuators are connected to a top plate (frame portions) in a similar arrangement. There are six attachments at the top which ease the construction of the system. The actuators move in synchronization to create motion in six directions as follows: Pitch (rotation about a transverse axis parallel to the top plate normally notated as the y axis in local coordinates); Roll (rotation about a longitudinal axis parallel to the top plate normally notated as the x-axis in local coordinates; Yaw (rotation about a vertical axis which intersects the x and y axes at their intersection and normally notated as the z-axis in local coordinates); Surge (translation along the x-axis); Sway (translation along the y-axis); Heave (translation along the z-axis); and combinations thereof.

Advantages and benefits of the systems and methods according to the teachings of the present invention include, but are not limited to hardware improvements, configuration flexibility, controls hardware and software, profile generating software tool, special effects library, event synchronization, motor synchronization, embedded motion profile playback, and a regenerative power system.

BRIEF DESCRIPTION OF DRAWINGS

Embodiments of the invention are described by way of example with reference to the accompanying drawings in which:

FIG. 14 is a table of actuator positions at their excursion limits for the Six Degree of Freedom system embodiment of FIG. 1, wherein various actuator positions are illustrated with reference to FIGS. 3-9, by way of non-limiting example;

FIGS. 18A and 18B together form a flow chart of one control system illustrating process and logic functions for a six degree of motion system, according to the teachings of the present invention, and hereafter together are referred to as FIG. 18;

DETAILED DESCRIPTION OF EMBODIMENTS

Figure 1:
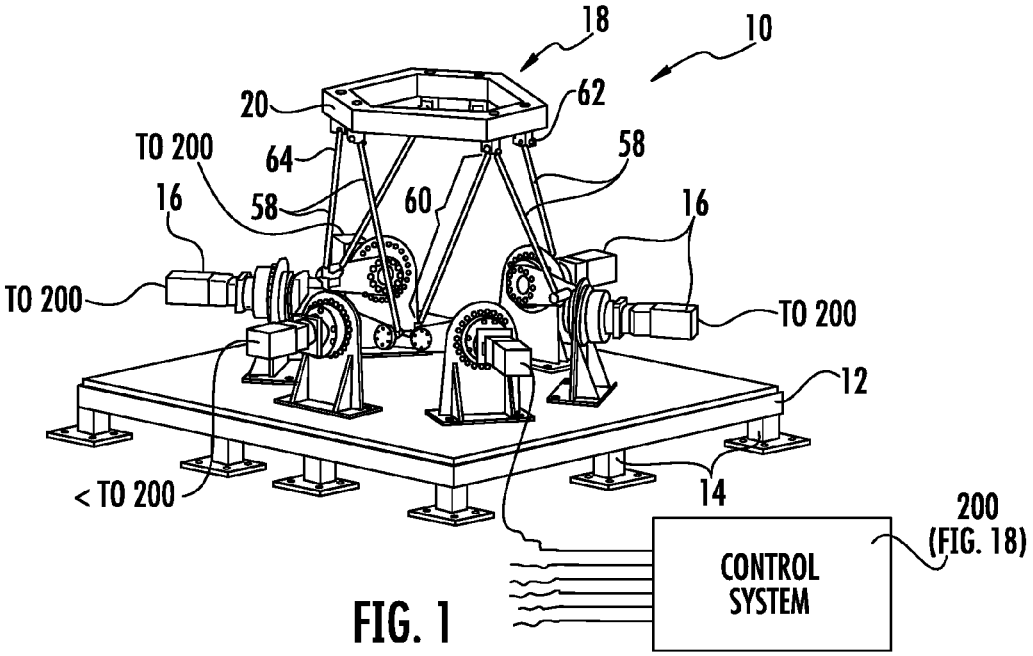
FIG. 1 is a perspective view of a Six Degree of Freedom, six-axis motion system, according to the teachings of the present invention.

The present invention will now be described more fully hereinafter with reference to the accompanying drawings, in which embodiments of the invention are shown by way of illustration and example. This invention may, however, be embodied in many forms and should not be construed as limited to the embodiments set forth herein. Rather, these embodiments are provided so that this disclosure will be thorough and complete, and will fully convey the scope of the invention to those skilled in the art. Like numerals refer to like elements.

In one embodiment of a motion simulation system according to the teachings of the present invention, and as illustrated with reference initially to FIG. 1, a motion system 10 is shown as a six-axis motion system. As noted, the motion system 10 can be provided with a variety of axis combinations from one to six axis systems, by way of example. The motion system 10 comprises a foundation in the form of a platform 12 with raised feet 14. The platform 12 can take a variety of configurations to supply the particular application of the system 10. The motion system 10 also includes a plurality of actuators 16, herein identified as 16*a*, 16*b*, 16*c*, 16*d*, 16*e* and 16*f*, with each actuator 16 mounted on the platform 12 spaced apart generally in a hexagonal arrangement by way of non-limiting example. Each actuator 16 (herein a single motor/gearbox actuator assembly) is connected to a section of a frame 18. By way of example, the frame 18, as herein described by way of non-limiting example, is formed with six individual sections of 20 A-F to illustrate a standalone structure. However, the system 10 may be connected to a selected simulator using three of the sections including 20A, 20C and 20E, each of which has upper portions of the connector rods 58 pivotally attached using upper bearings 62. The frame 18, or sections thereof, is configured to be connected to the platform 12 for a particular application of an embodiment the motion system 10 for a flight simulator or an amusement ride, by way of example.

Figure 2:
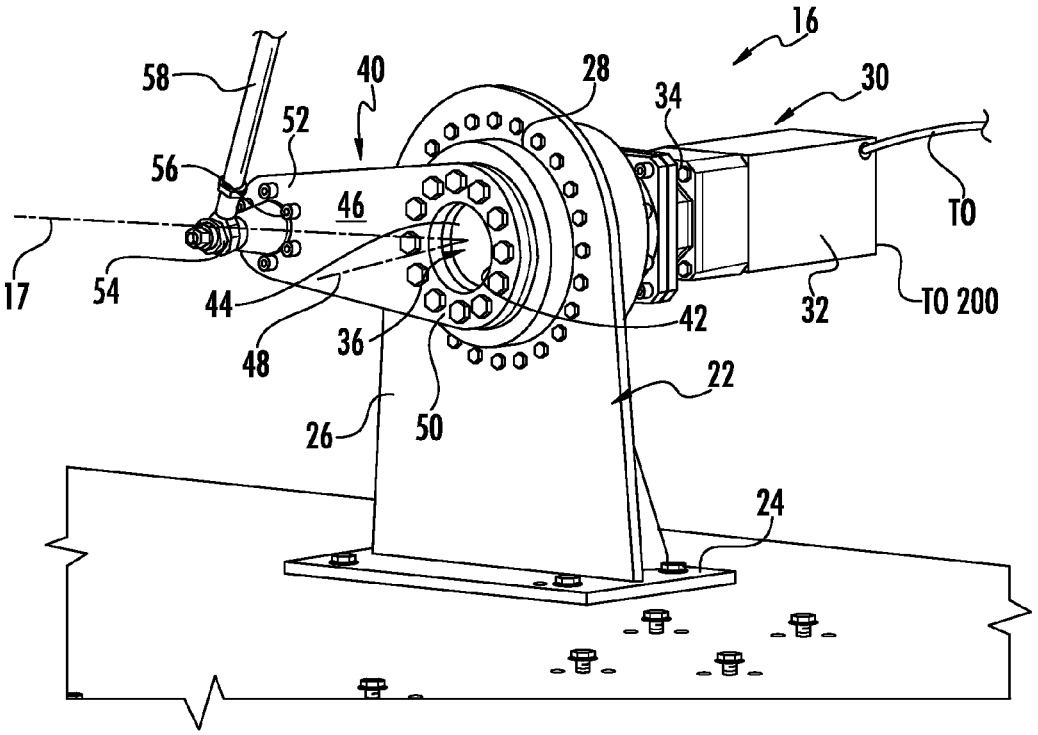
FIG. 2 is a perspective view of an actuator used with the Six Degree of Freedom, six-axis motion system of FIG. 1.

Each of the actuators 16 (16*a*, 16*b*, 16*c*, 16*d*, 16*e* and 16*f*) is comprised of components described in relation to the actuator 16 having the single motor/gearbox assembly in FIG. 2, by way of example. The actuator 16 includes a main actuator support 22 having a base or foot 24 connected to the platform 12 and a vertical stand 26 rising from the foot 24 and having an aperture 28 in an upper portion of the vertical stand configured to receive a motor/gearbox assembly 30. The motor/gearbox assembly 30 includes an electric servomotor 32 connected to a planetary gearbox 34 which motor/gearbox assembly 30 is engaged with a drive shaft 36 at a proximal end thereof which is driven by the motor 32. The motor 32, the gearbox 34 and the drive shaft 36 is therein provided as a single unit referred to the "motor/gearbox assembly" 30 but can be provided as separate components without departing from the teachings of the present invention.

The motor 32 is an electrical servo motor that is controlled by a control system as will later be described.

With continued reference to FIGS. 1 and 2, the motor/gearbox assembly 30 is connected to a main crank 40 having an aperture 42 surrounding a distal end 44 of the drive shaft 36. The crank 40 is a rigid, elongated member having a face 46 connected perpendicularly to the plane of a longitudinal axis 48 of the drive shaft 36 at a proximal end portion 50. A distal end 52 of the crank 40 receives a lower spherical bearing 54 connected through a second aperture 56 in the crank. The lower spherical bearing 54 connects the crank to a connector rod 58. The lower spherical bearing 54 is selected to allow rotational movement of the connector rod 58.

Figure 1A:
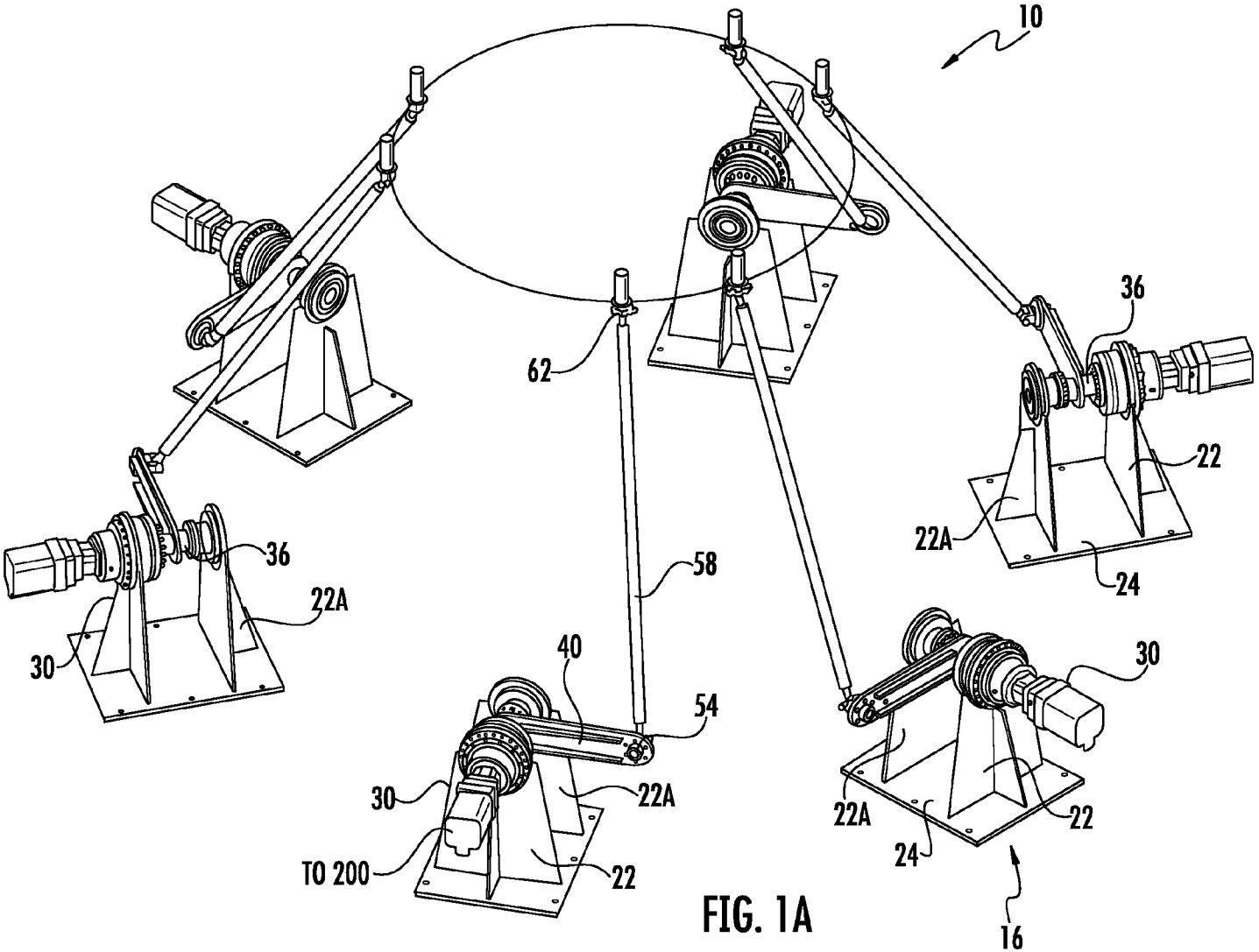
FIG. 1A is a perspective view of an alternate embodiment of the system of FIG. 1 employing single motor actuators with alternate supporting shaft member.

As illustrated with reference to FIG. 1A, and within the teachings of the present invention, the system 10 may include actuators 16 employing the single motor/gearbox assembly 30, but having the distal end of its shaft 36 rotatable supported by a second support 22A.

Figure 3:
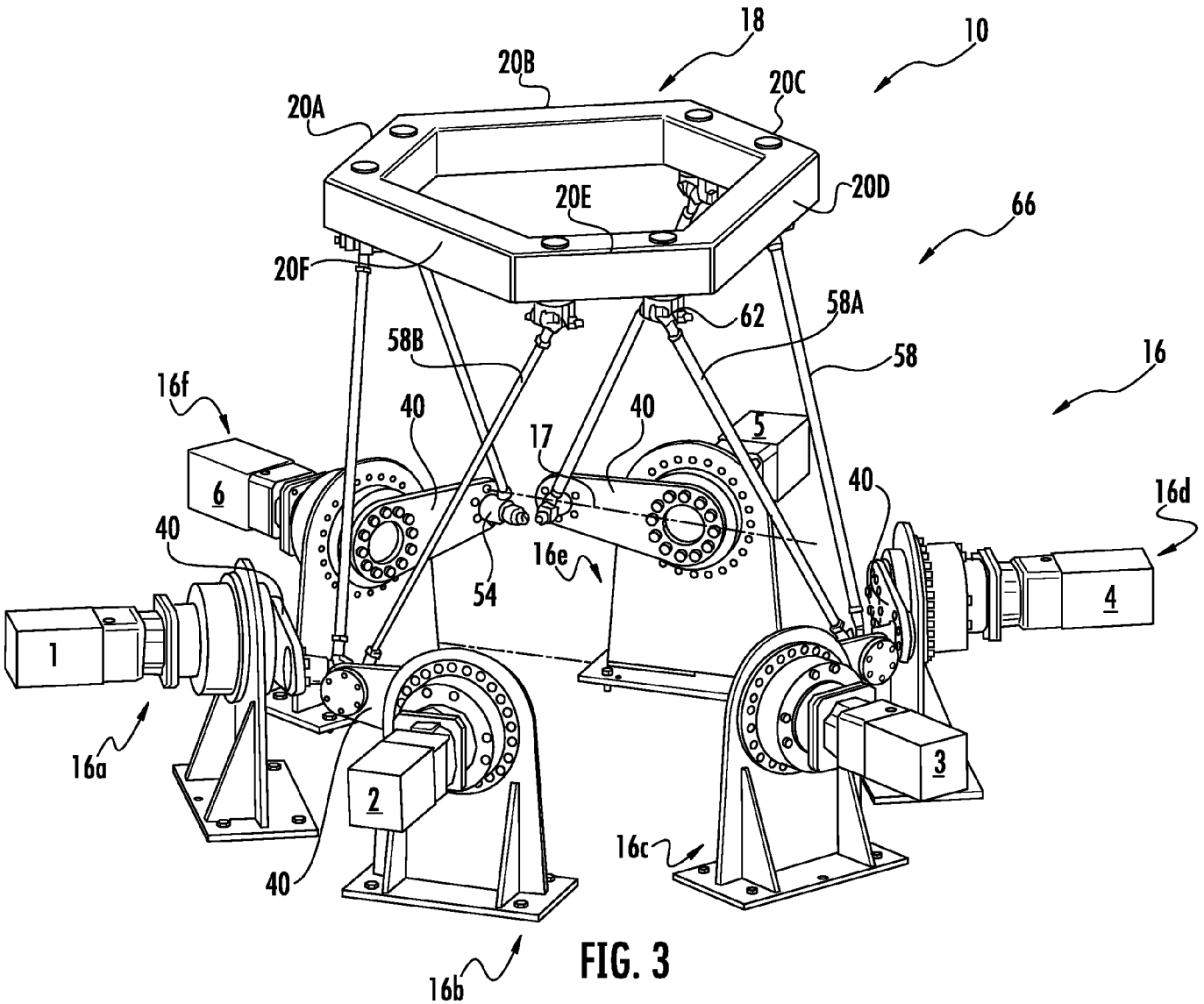
FIG. 3 is a perspective view of the Six Degree Freedom system in a neutral position.

The connector rod 58 has an elongated form in a predetermined length 60 determined to provide a desired motion for the application of interest. The connector rod 58 is connected to an upper spherical bearing 62 positioned at a distal end 64 of the connector rod 58 opposite the crank 40. The upper spherical bearing 62 connects the connector rod 58 to the frame 18 such that the connector rod 58 can move through a range of orientations with respect to the frame and the crank 40. Each actuator 16*a*, 16*b*, 16*c*, 16*d*, 16*e* and 16*f* is of similar construction. The connector rods 58A-58F are connected to the frame 18 in pairs of adjacent connector rods, such as 58A, 58B connected at ends of a section 20 as illustrated with reference again to FIG. 3. This arrangement allows for movement in the six degrees of freedom. The frame 18 or frame section thereof 20A, 20C, 20E are configured to attach to an desired assembly, whose movement is to be driven by the system 10.

The connector rods 58A-58F and cranks 40 A-F are arranged to allow the cranks to rotate and allow the connector rods to travel through a desired plane of motion. As each connector rod 58 travels through its path, the frame 18 is moved to a range of orientations as illustrated by way of example with reference again to FIG. 3 and now FIGS. 3-9 for neutral, heave, pitch, roll, surge, sway and yaw as well-known and desired movements illustrated with reference to FIG. 10. With six connector rod/crank combinations attached to the top frame, the platform can range through the six degrees of freedom motion.

The motion system 10 can utilize a single axis, or multi-axis systems including by way of example only, one, two, three and six axes. The motion system 10 components can be varied to provide such different configurations. For example, the number, size and positioning of components can be varied such as varying the number of cranks 40, connector rods 58 and frame sections 20. The electric motors 32 and planetary gear boxes 34 can be provided according to the number of axes, or some multiple of the number of axes. By way of example, the system 10 can be provided with two motors 32 and two gearboxes 34 per actuator 16 or even up to four motors 32 and four gearboxes 34 per actuator 16. As illustrated with reference to FIGS. 11 and 12, respectfully. By way of example and as illustrated with reference to FIG. 11, the embodiment herein described includes the actuator 16 including a dual motor/gearbox assembly operable with one crank 40 (herein referred to as 16D). Yet further, an actuator, according to the teachings of the present invention, may include a four or quad motor/gearbox assembly as illustrated with reference to FIG. 12 as actuator 16Q. Such an actuator 16Q is useful with a 3 DOF motion system 100, illustrated with reference to FIG. 13. With continued reference to FIG. 12, the actuator 16Q includes a beam 102 to which arm members 104 are pivotally connected at their distal ends 106 to the beam 102 and at their proximal ends 108 to cranks 110 at distal ends 112 thereof. With reference again to FIG. 13, two cranks 110 are paired to be connected to the arm member 104. Yet further, two dual motor/gearbox assemblies 114 are themselves paired to form the quad actuator 16Q. Thus, four motors and four gearboxes drive the single quad actuator 16Q.

With reference again to FIG. 1, in a six axis configuration, the motor/gearbox/drive shaft and crank arm are placed at 90° angles. The crank arms and connecting rods use spherical bearings and do not work in the same plane of motion. This provides six degrees of freedom by rotation in three directions and combinations and translation in three directions. One connecting rod 38 is provided per actuator 16 with two spherical bearings 54, 62 per rod 16, one bearing at each end of the connecting rod as above disclosed.

By way of contrast, in a two axis system, the motor/gearbox/drive shaft and crank arm are positioned along a common line such that the crank arm and connecting rod operate in a same plane. By way of example, this provides 2 degrees of freedom, a single rotation and single translation degree. With appropriate constraints in controls and/or structure, such a configuration can also be used for a one degree of freedom system.

Figure 10:
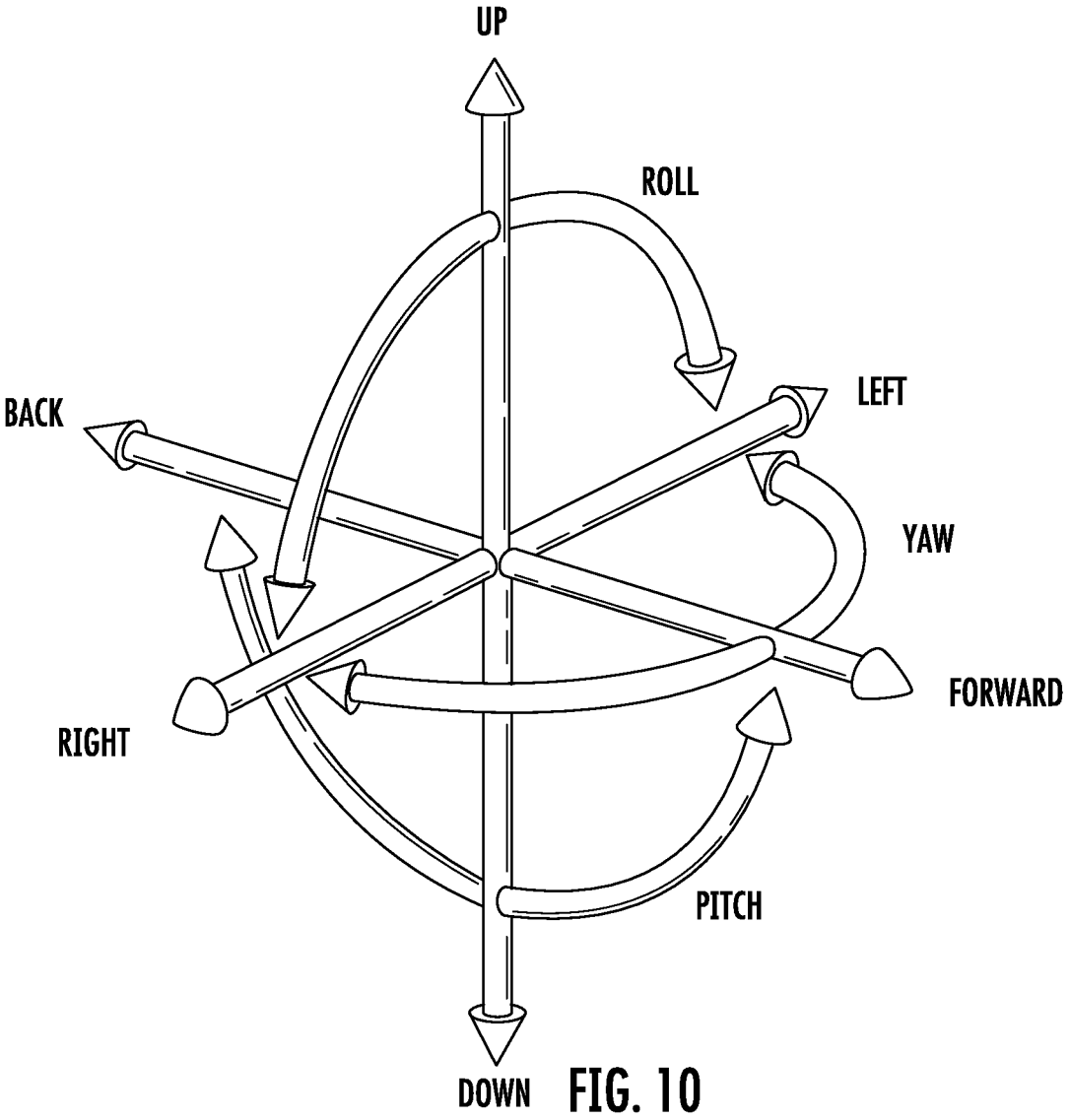
FIG. 10 is a diagrammatical illustration of movements in the Six Degree of Freedom system about three axes.

In the embodiment of the Six Degree of Freedom System 10, as illustrated with reference again to FIGS. 1 and 11, each actuator 16, 16D is put in position to enact the desired movement such as neutral, roll, pitch, yaw, surge, sway, heave or a combination thereof, as above described with reference to FIG. 10. The system comprises 6 actuators equally spaced at 60° apart on the base or platform 12. The actuators 16 are connected to the frame 18 in a similar arrangement to the typical Stewart system configurations. As a result, there are six attachments at the top which eases the construction of the system. The actuators 16 move in perfect synchronization to create motion in 6 axes as earlier described. With Pitch (rotation about a transverse axis parallel to the top plate normally notated as the y axis in local coordinates); Roll (rotation about a longitudinal axis parallel to the top plate normally notated as the x-axis in local coordinates; Yaw (rotation about a vertical axis which intersects the x and y axes at their intersection and normally notated as the z-axis in local coordinates); Surge (translation along the x-axis); Sway (translation along the y-axis); Heave (translation along the z-axis); and combinations of all the above motions.

The movements of this exemplary six axis system 10 in actuator positions and at their excursion limits are further described in the exemplary Table of FIG. 14. The rotational positions of the actuators 16 are denoted with rotation above a horizontal plane 17, illustrated in FIG. 3 by way of example. Sample movements are shown with each actuator 16*a*, 16*b*, 16*c*, 6*d*, 16*e* and 16*f*. As above described, the system 10 is shown at neutral position 66 in FIG. 3. The cranks 40 in the neutral position are all aligned generally parallel horizontal plane to the platform 12. The connector rods 58 are angularly disposed from the crank 40 up to the connection at the frame 18.

Figure 4:
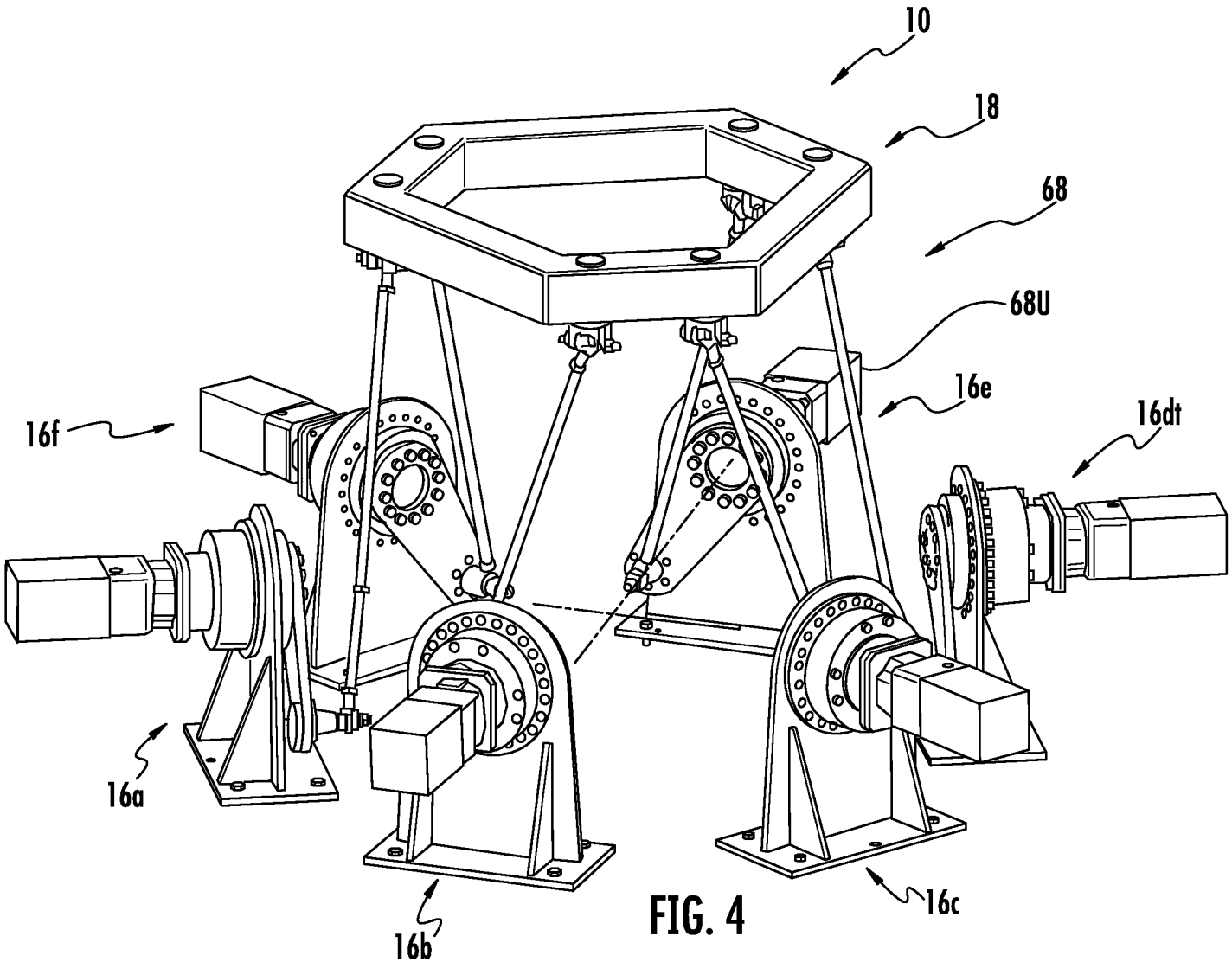
FIGS. 4 and 4A are perspective views of the Six Degree of Freedom system in heave down and heave up moments, respectively.

The system 10 is shown at a heave movement position 68 in an heave downward platform 12 in FIG. 4. As illustrated with reference to FIGS. 3 and 4, the cranks 40 are all in a 45 degree angle below the horizontal plane 17 of the base or platform 12, by way of example. The cranks 40 are positioned in alternating angled position with respect to the neighboring actuator 16. The connector rods 58 are disposed from the crank 40 up to the connection at the frame 18.

Figure 4A:
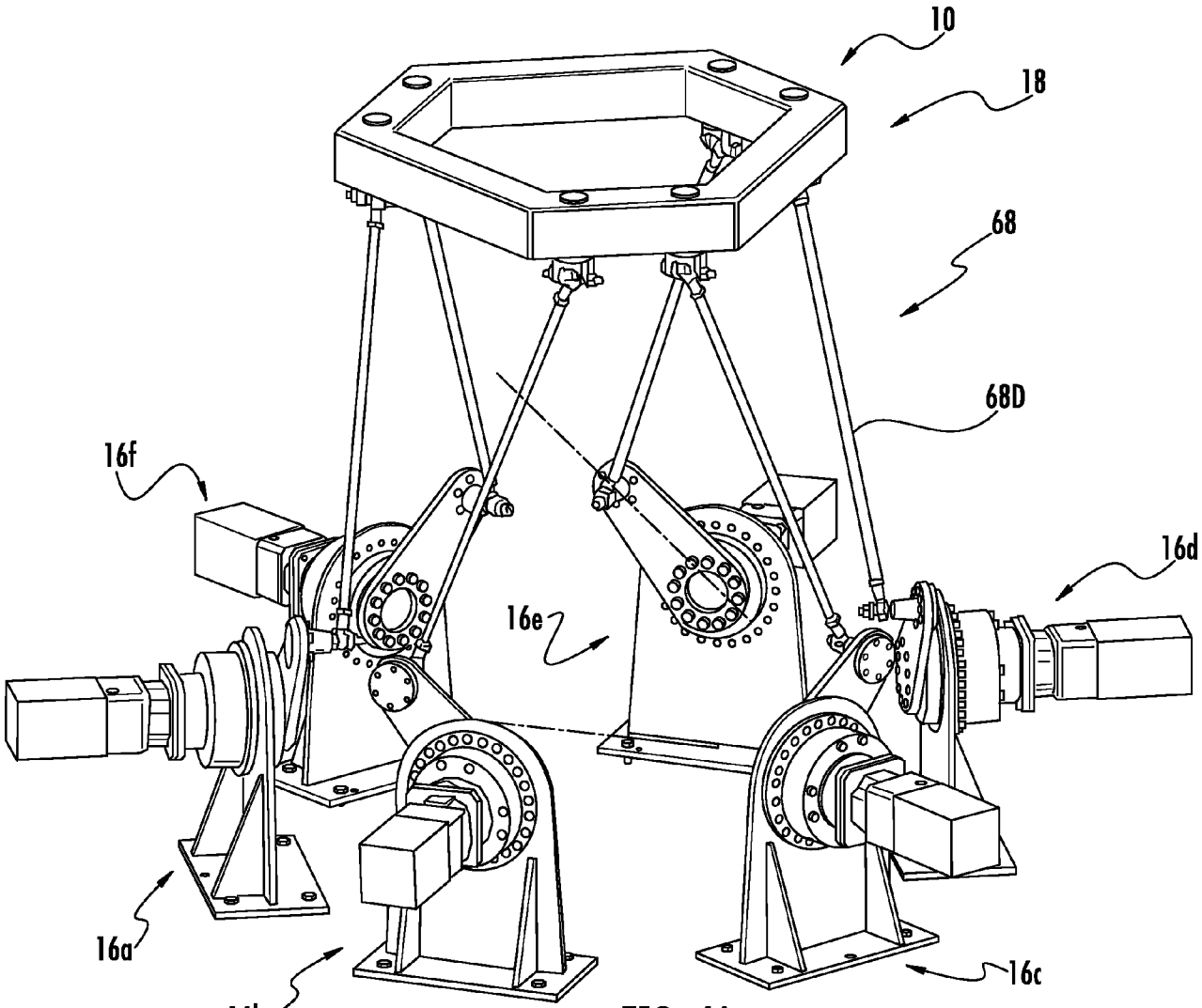

The system 10 is shown in a heave movement position 68 in a heave upward position from the platform 12 in FIG. 4A. As shown in FIG. 4A, the cranks 40 are all in a 45 degree angle above the horizontal plane 17 of the platform 12, wherein the horizontal plane is herein designated a neutral position for the cranks, by way of non-limiting example. The cranks 40 are positioned in alternating angled position with respect to the neighboring actuator 16. The connector rods 58 are disposed from the crank 40 up to the connection at the frame 18.

Figure 5:
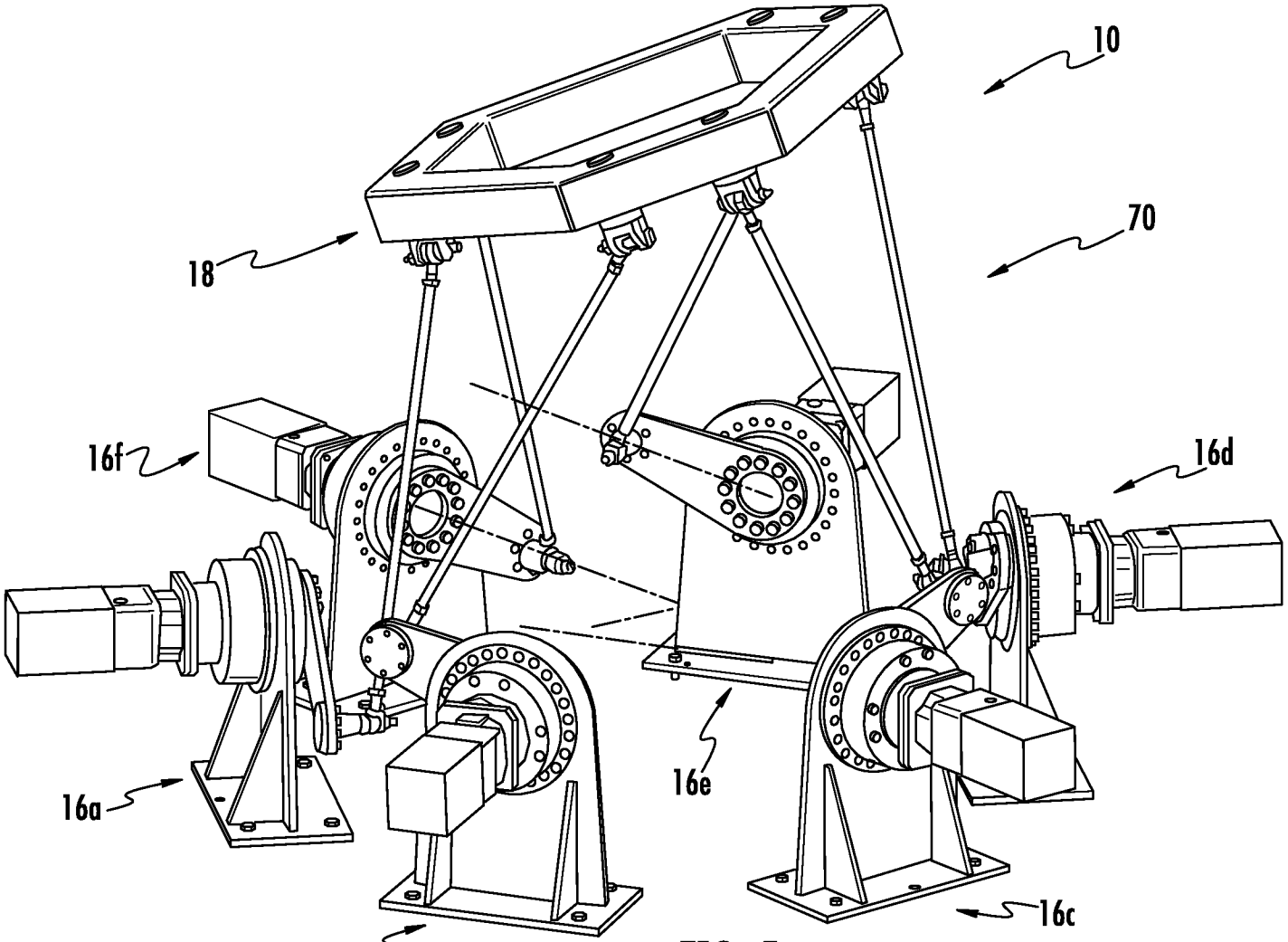
FIG. 5 is a perspective view of the Six Degree of Freedom system in a pitch movement.

The system 10 is shown in a pitch movement position 70 in FIG. 5. Wherein the cranks 40 have varying positions and angles above and below the horizontal plane of the actuators 16 and parallel to the platform 12 as illustrated and further described in Table of FIG. 14.

Figure 6:
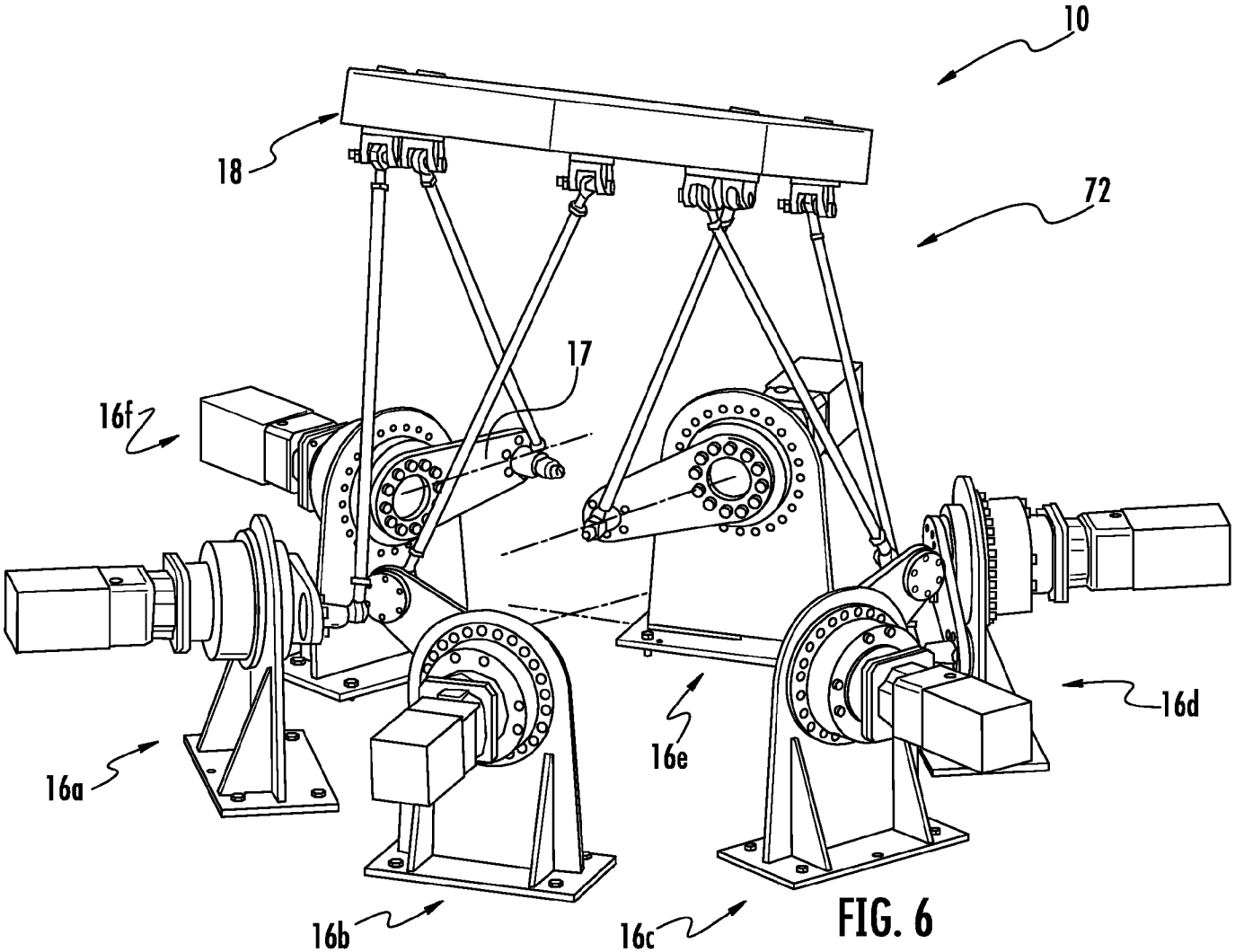
FIG. 6 is a perspective view of the Six Degree of Freedom system in a roll movement.

The system is shown in a roll movement position 72 in FIG. 6. Wherein, the cranks 40 are in varying positions and angles above and below the horizontal plane of the actuators 16 and parallel to the platform 12 as shown in the table of FIG. 14.

Figure 7:
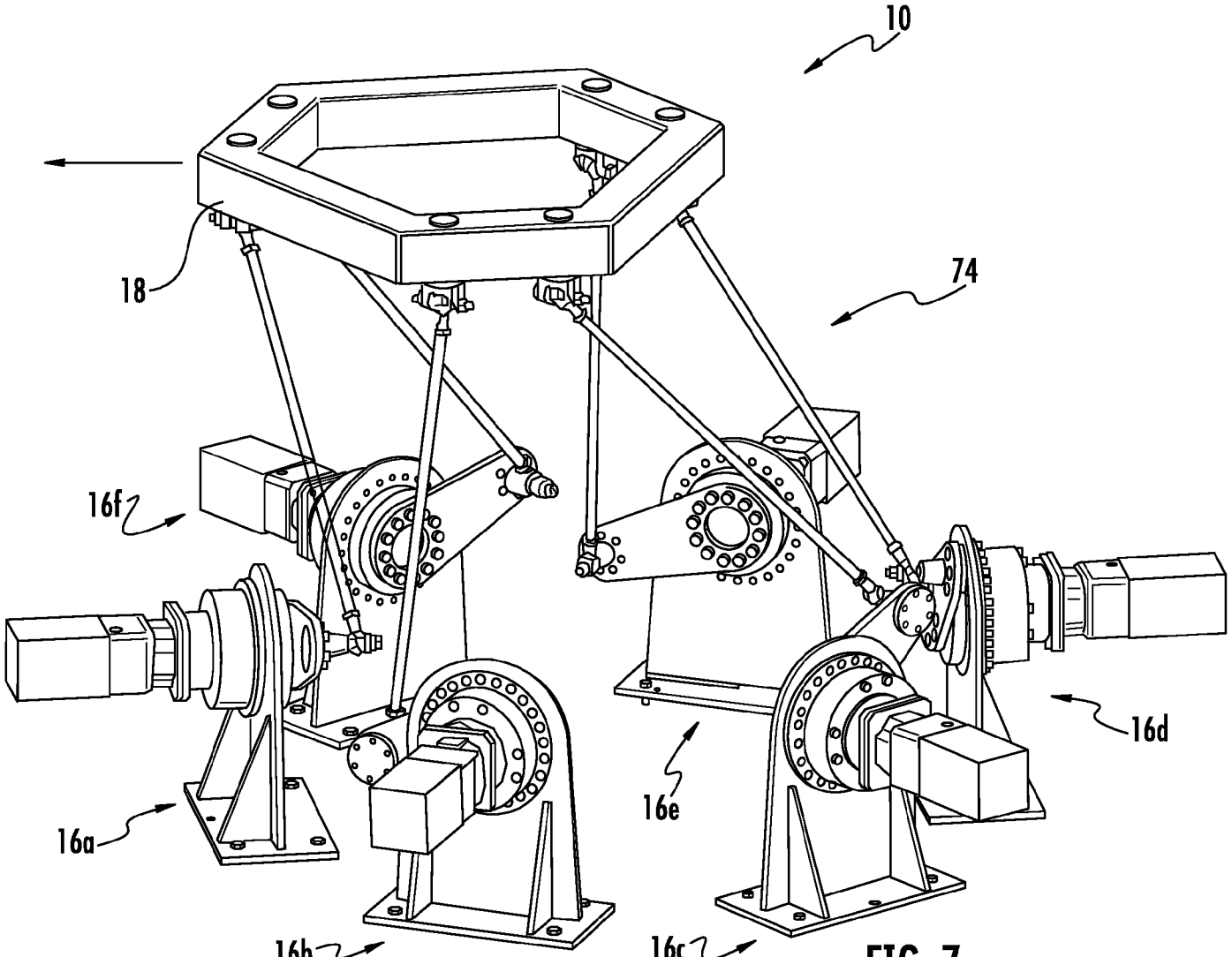
FIG. 7 is a perspective view of the Six Degree of Freedom in a surge movement.

The system is shown in a surge movement position 74 in FIG. 7. Wherein the cranks 40 are in varying positions and angles above and below the horizontal plane of the actuators 16 and parallel to the platform 12 as shown in the table of FIG. 14.

Figure 8:
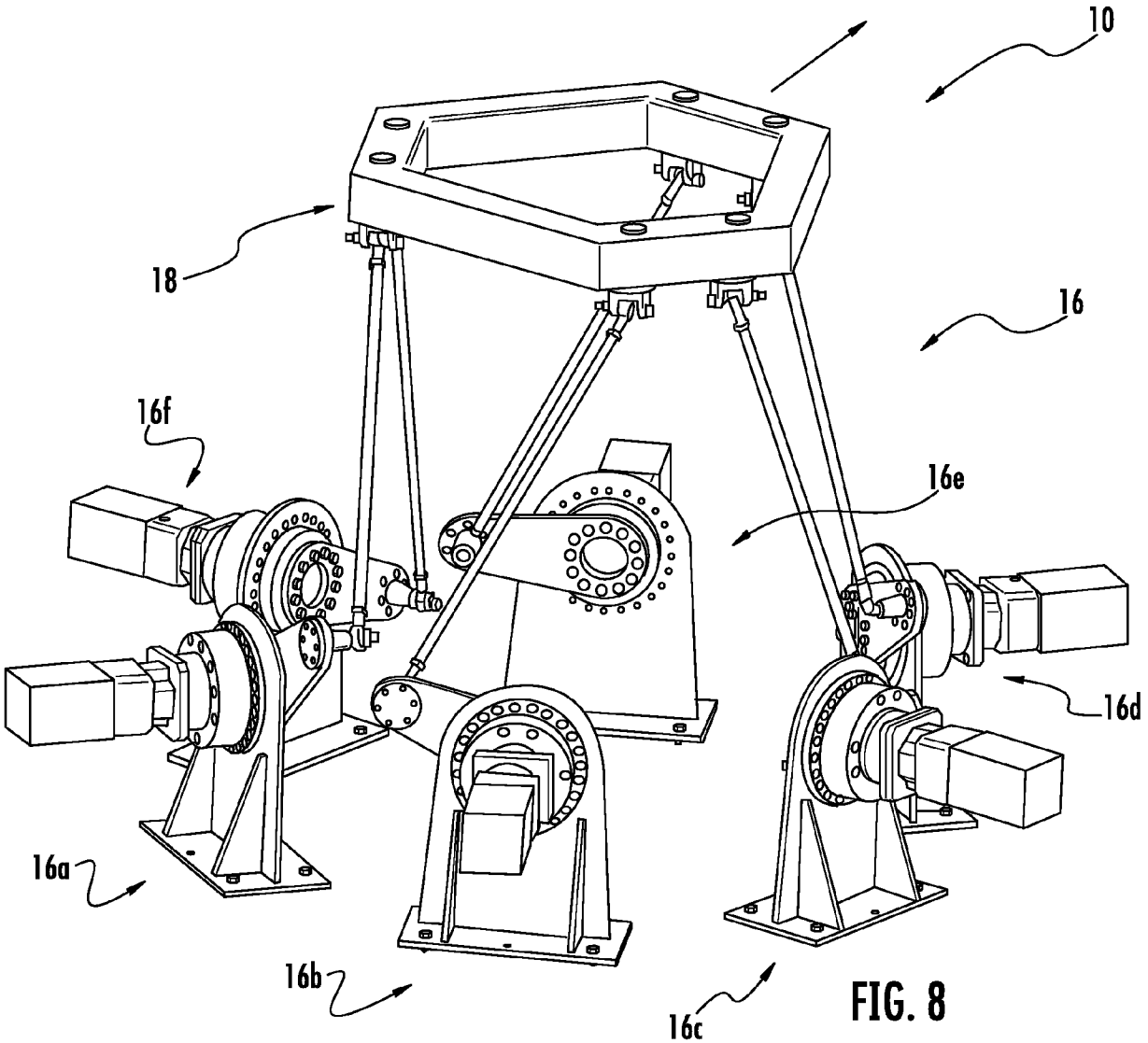
FIG. 8 is a perspective view of the Six Degree of Freedom system in a sway movement.

By way of further example, the system 10 is shown in a sway movement position 76 in FIG. 8. Whereas, the cranks 40 are in varying positions and angles above, below and even with the horizontal plane of the actuators 16 and parallel to the platform 12 as shown in the table of FIG. 14.

Figure 9:
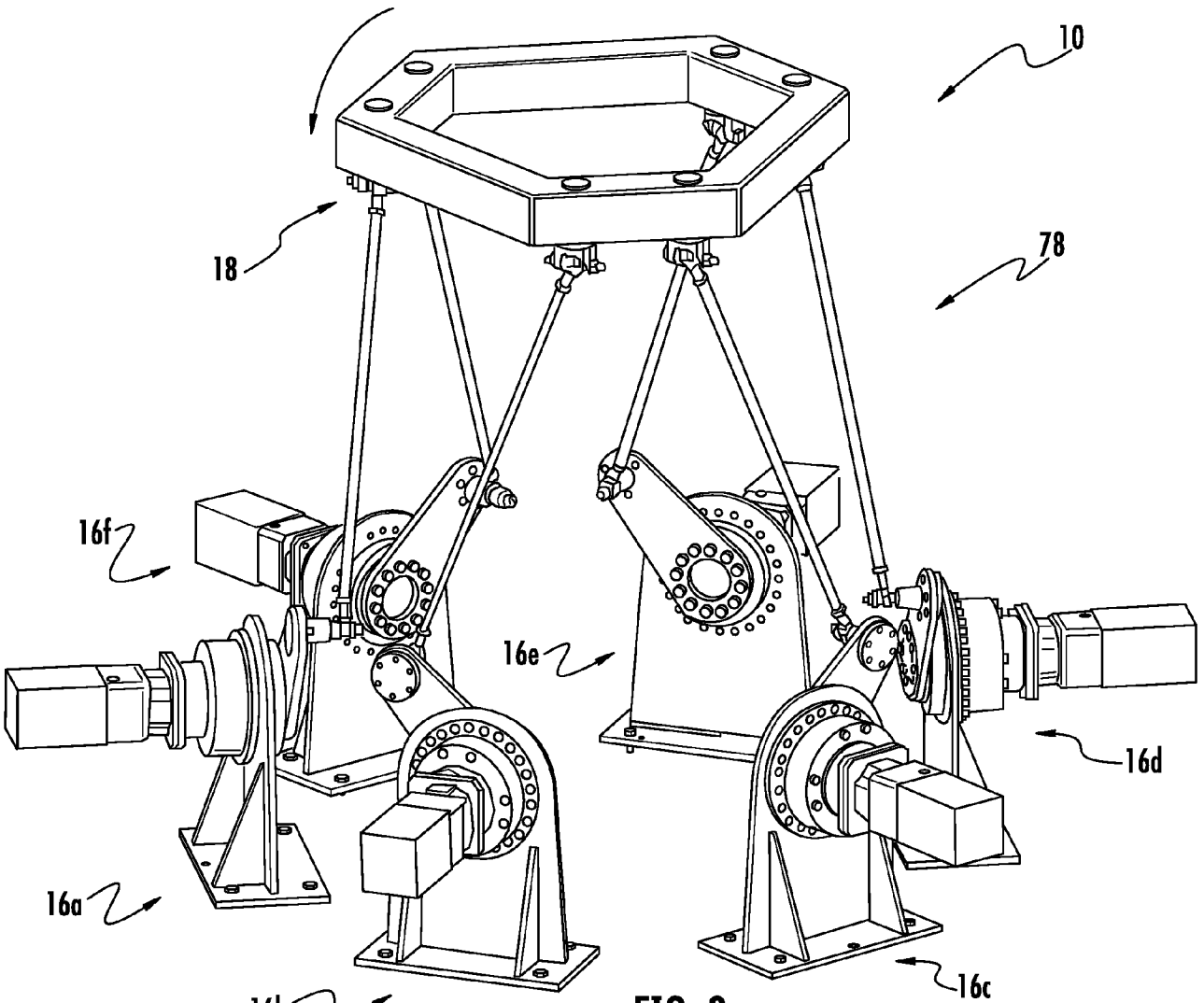
FIG. 9 is a perspective view of the Six Degree of Freedom system in a yaw movement.

Yet further, the system is shown in a yaw movement position 78 in FIG. 9, whereas the cranks 40 are in varying positions and angles above, below and even with the horizontal plane of the actuators parallel to the platform 12 as shown in the table in FIG. 5. The connector rods 58 are angularly disposed from the cranks 40 up to the connection at the frame 18.

Figure 12:
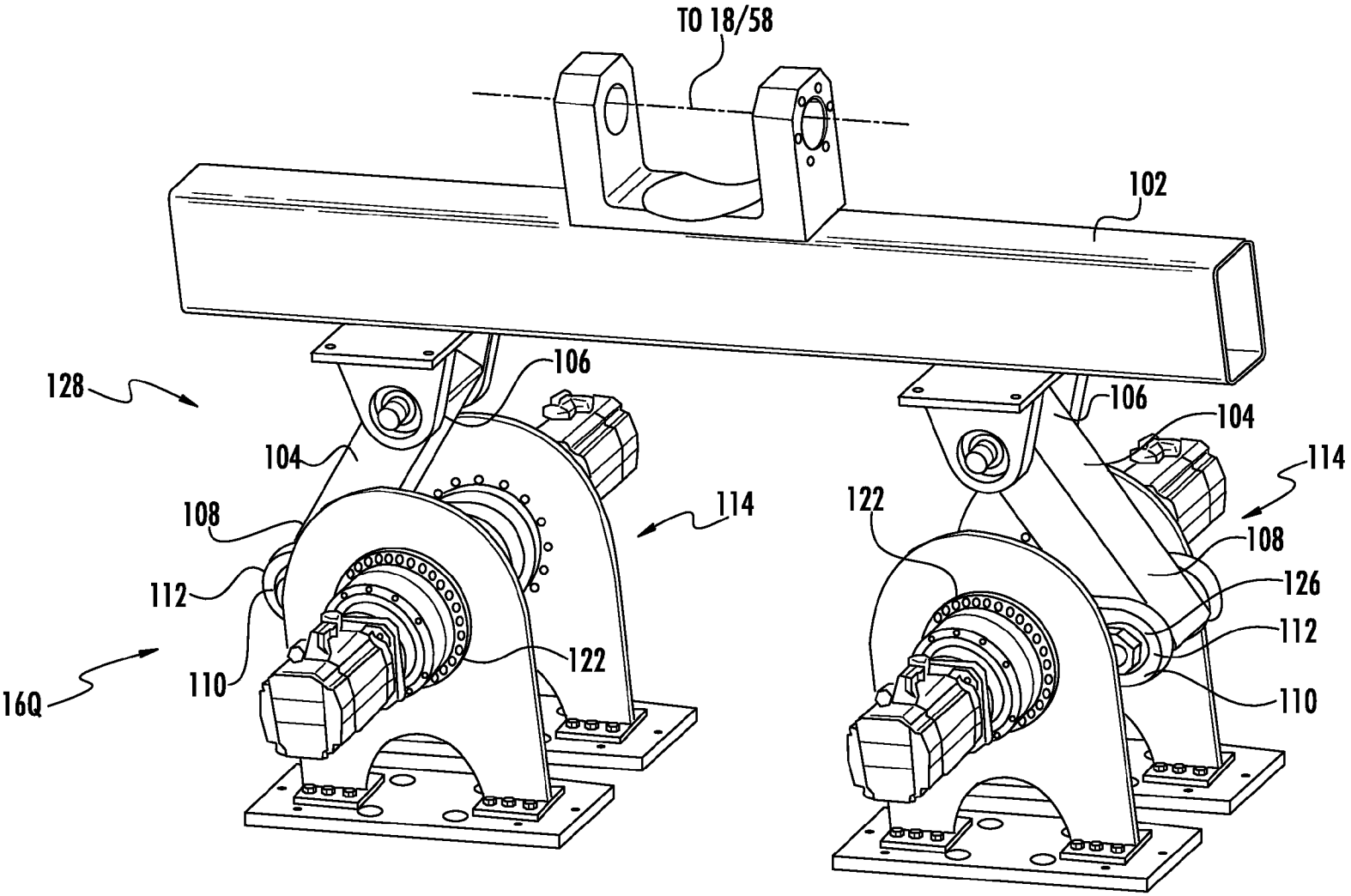
FIG. 12 is a perspective view of a quad motor/gearbox actuator useful in a three-axis motion system.
Figure 12A:
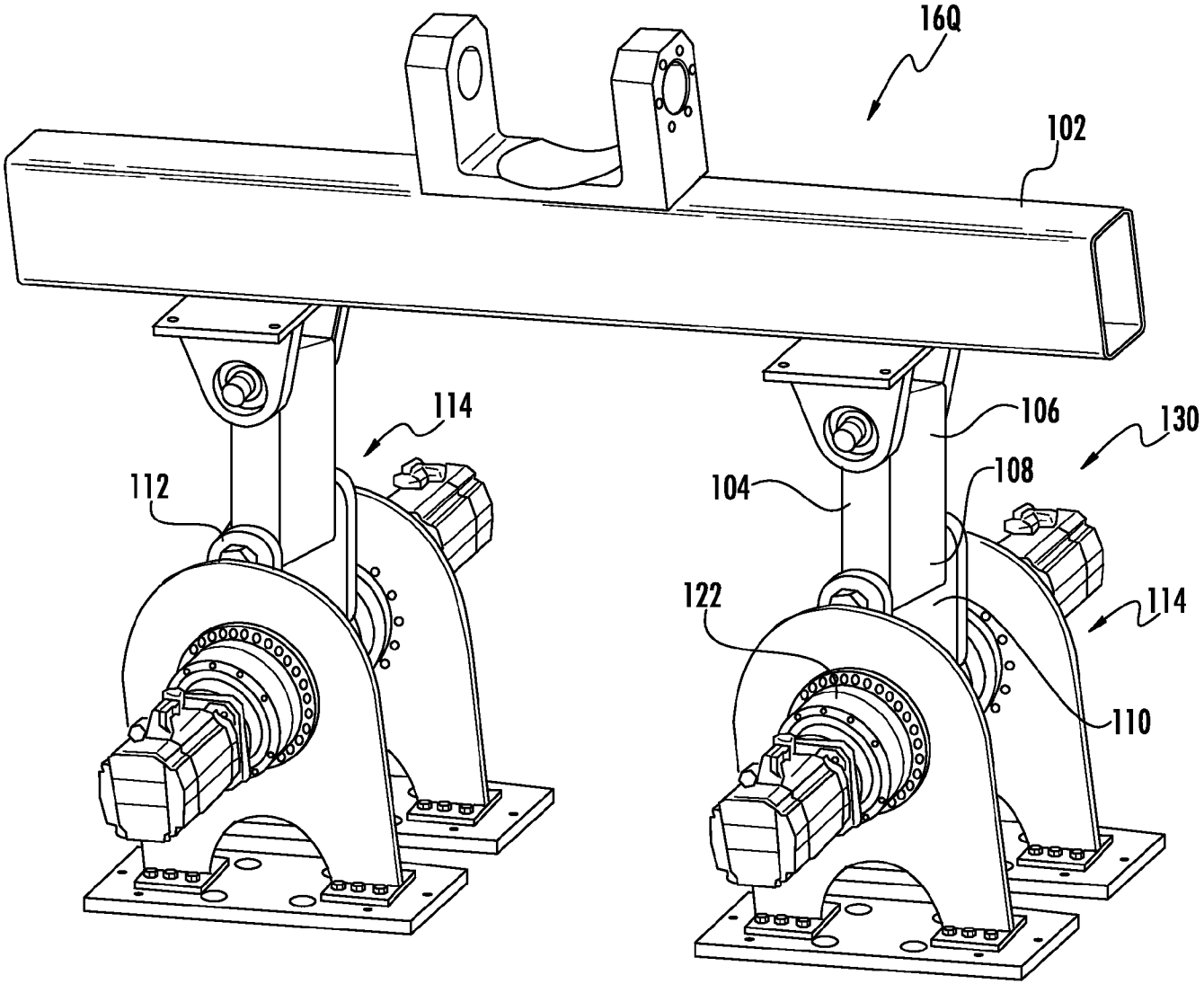
FIGS. 12A and 12B are perspective views of the quad motor/gearbox actuator of FIG. 12 in fully up and fully down positions, respectively.

The positions of the actuators 16, illustrated with reference to FIG. 12A, are for maximum excursions herein presented, by way of non-limiting example. The actuators 16 can be put into a plurality of intermediate positions as programed through the control system. By way of example, the Table in FIG. 14 shows excursion distances for different types of movements such as pitch up and pitch down, roll left side up and roll left side down, yaw right and yaw left, surge forward and surge backward and sway left and right. The range of motion is particularly suited to applications such as used in flight simulators.

In another embodiment of a motion system according to the teaching of the present invention, the 3 DOF system 100 as depicted in FIG. 13 is again referenced. As described for the system 10, earlier described with reference to FIG. 1, the motion system 100 comprises a foundation in the form of a platform 116. The motion system 100 also includes a plurality of actuators the actuators 16Q, earlier described with reference to FIG. 12. Each actuator 16Q is mounted on the platform 116 and spaced apart in a generally triangular arrangement. As above described, the system 100 includes the actuators 16Q having the motors/gearbox and crank assemblies connected to the load beam 102 with a U-fork styled connection 118. Each actuator 16Q is connected to the frame 18 via a swivel connector 120 connected to the U-fork connection 118. The three beams 102, herein described by way of example, accept the frame 18 via the U-fork connection 118. The top frame comprises three elongated sections forming a triangular frame 18. The frame 18 is configured to be connected to a platform for a particular motion simulation application, in this embodiment a motion system for an amusement embodiment, by way of example. In this three axis embodiment for the system 100, the platform may be that used in an amusement ride, as will be illustrated by way of example later is this disclosure.

Figure 13:
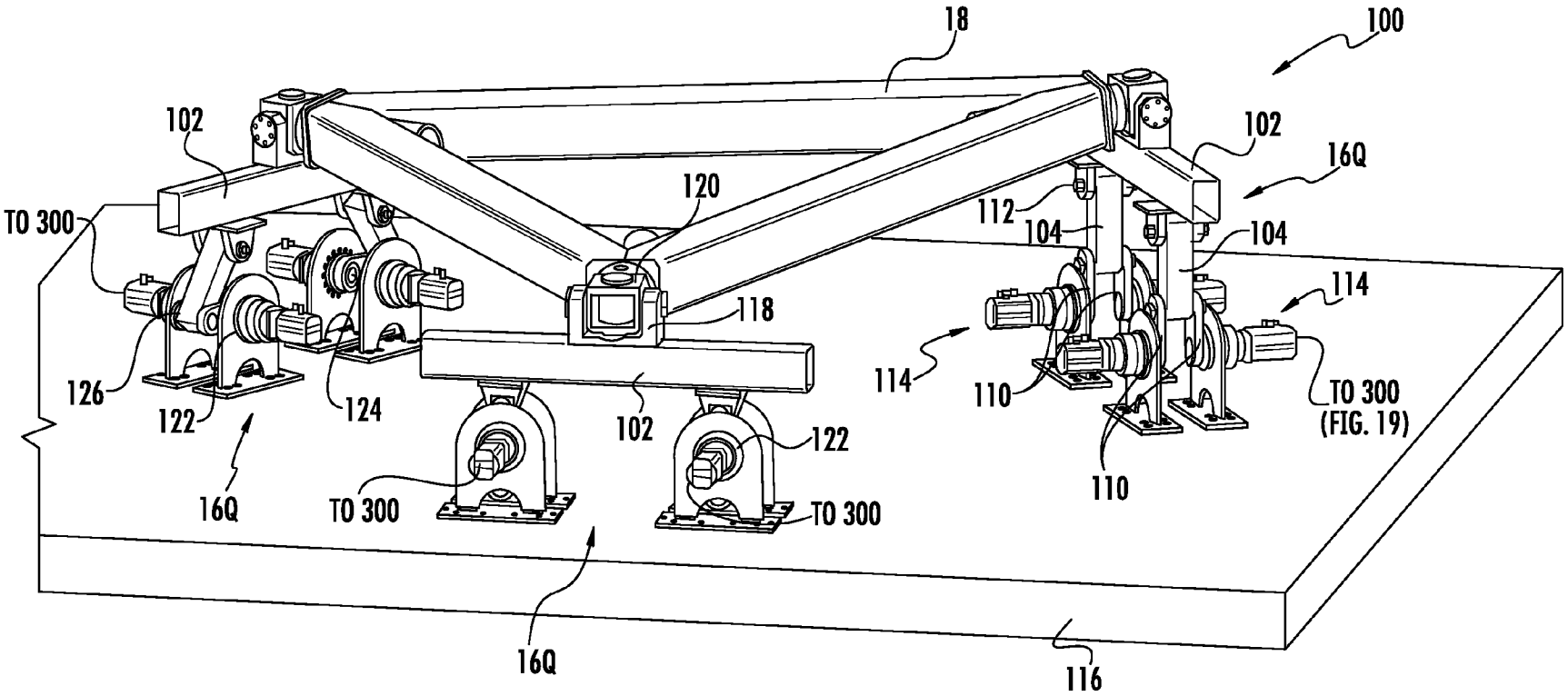
FIG. 13 is a perspective view of a three-axis motion system according to the teachings of the present invention, wherein the system employs the actuators of FIG. 12 and shown in a neutral position.

Each of the actuators 16Q used in the three DOF system of FIG. 13 is comprised of components described for the actuator of FIG. 12, and as described earlier with reference to the actuator of FIG. 2. By way of example, each actuator includes an actuator supports. Each actuator support includes the base or foot 24 and vertical stand 26. each foot 24 is connected to the platform 12 as the base and a vertical stand rises from each foot, as herein described by way of example. Optionally, the actuator stands 26 may be affixed directly to the platform 12 as a base without departing from the teachings of the present invention. Each stand 26 has an aperture in an upper portion configured to receive a motor/gearbox assembly which is comprised of an electric servo motor connected with a planetary gearbox which is engaged with a proximal end of the drive shaft which is driven by the motor. The motor, gearbox and shaft can be provided as a single unit herein referred to as "motor/gearbox assembly" or can be provided as separate components. As illustrated with continued reference to FIG. 12, the actuator 16Q includes two dual motor/gearbox assemblies with each of the four motor/gearboxes carried by a stand and each motor/gearbox operable with a crank 110 that is rotatable attached to first and second arm members 104.

The motor is an electrical servo motor that is controlled by the control system as described below, by way of example.

With reference again to FIG. 12, the actuator 16Q includes dual motor/gearbox assembly 114 pivotally connected to the crank 110 having an aperture 122 surrounding a distal end of a drive shaft 124. The cranks 110 are rigid, elongated members having a face that is connected perpendicularly to the plane of the longitudinal axis of the drive shaft in a first end portion, as above described with reference to FIG. 2. The distal end of the crank receives the arm member 104 using a bearing 126 connected through a second aperture in the cranks. The lower bearing connects the cranks to arm members and selected to allow rotational movement within a plane. The two cranks drive each arm member of the two arm members used for the actuator 16Q herein described by way of example. The use of four motors allows for additional power and thus supports heavier than typical payload structure.

As was described for the connector rod 58 of FIG. 1, the arm members 104 have an elongated form in a predetermined length determined to provide desired motion for the application. The dual motor/gearbox assemblies 114 of the actuator 16Q can move independently to move the load beam 102 into various positions. The arm members and cranks are arranged to allow the crank to rotate 360 degrees and the arm member to travel through a full circle for certain desired applications. As the arm member travels through its path, the frame is moved to a range of orientations as desired for a 3 DOF system, as above described with reference to FIG. 1 for a 6 DOF system. With three connections 120 attached to the three load beams 102, the frame 18 is effectively moved through motion having three degrees of freedom motion.

Figure 12B:
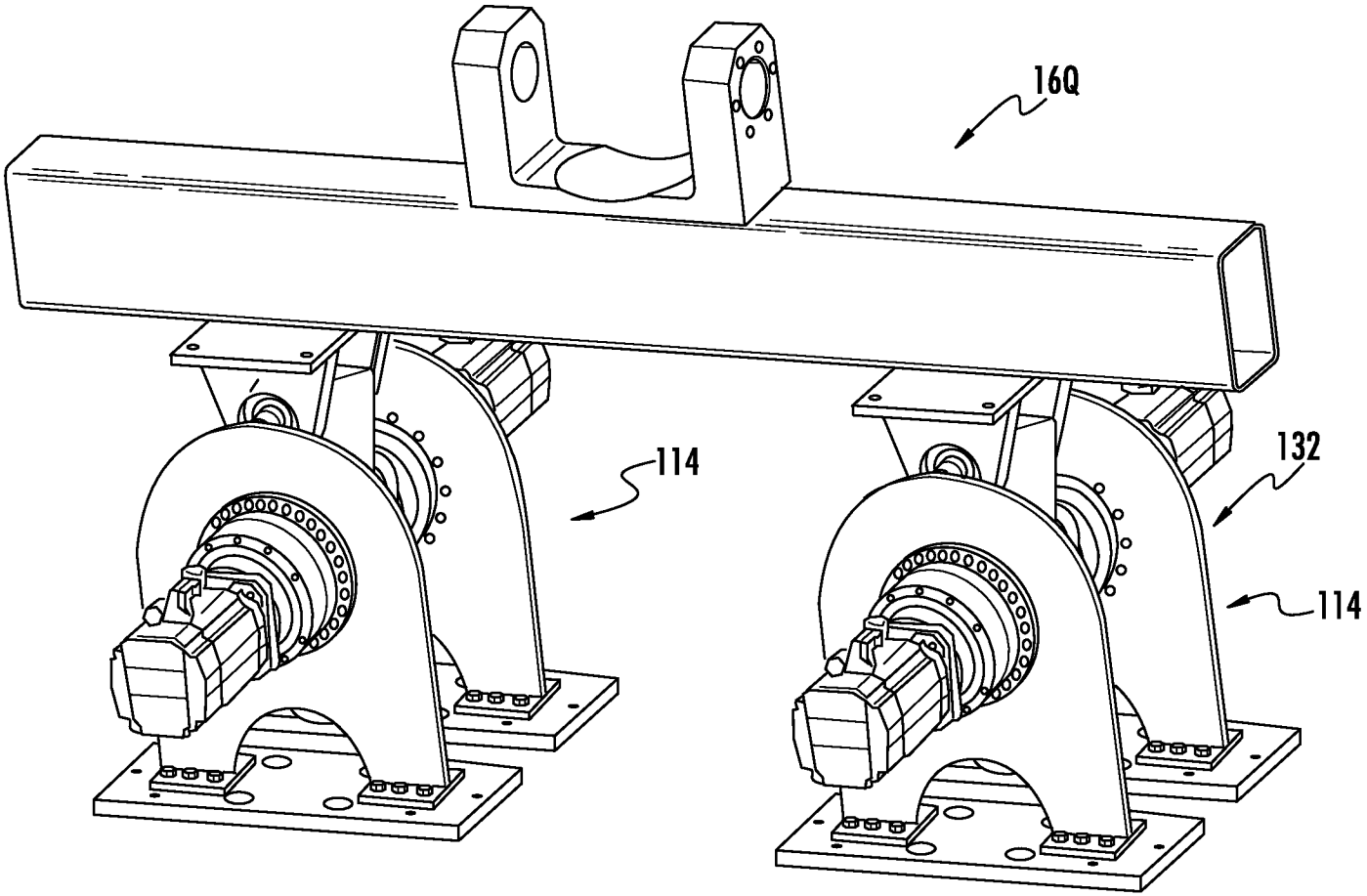

By way of example, the actuator 16Q illustrated with reference again to FIG. 12 may be considered as shown in a neutral position 128, with the actuator 16Q shown in a fully extended up position 130 in FIG. 12A and full down or lowest position 132 in FIG. 12B. As will be understood by those skilled in the art now having the benefit of the teachings of the present invention, various rotations of the cranks will provide various orientations within the 3 DOF system 100, as desired.

Figure 11:
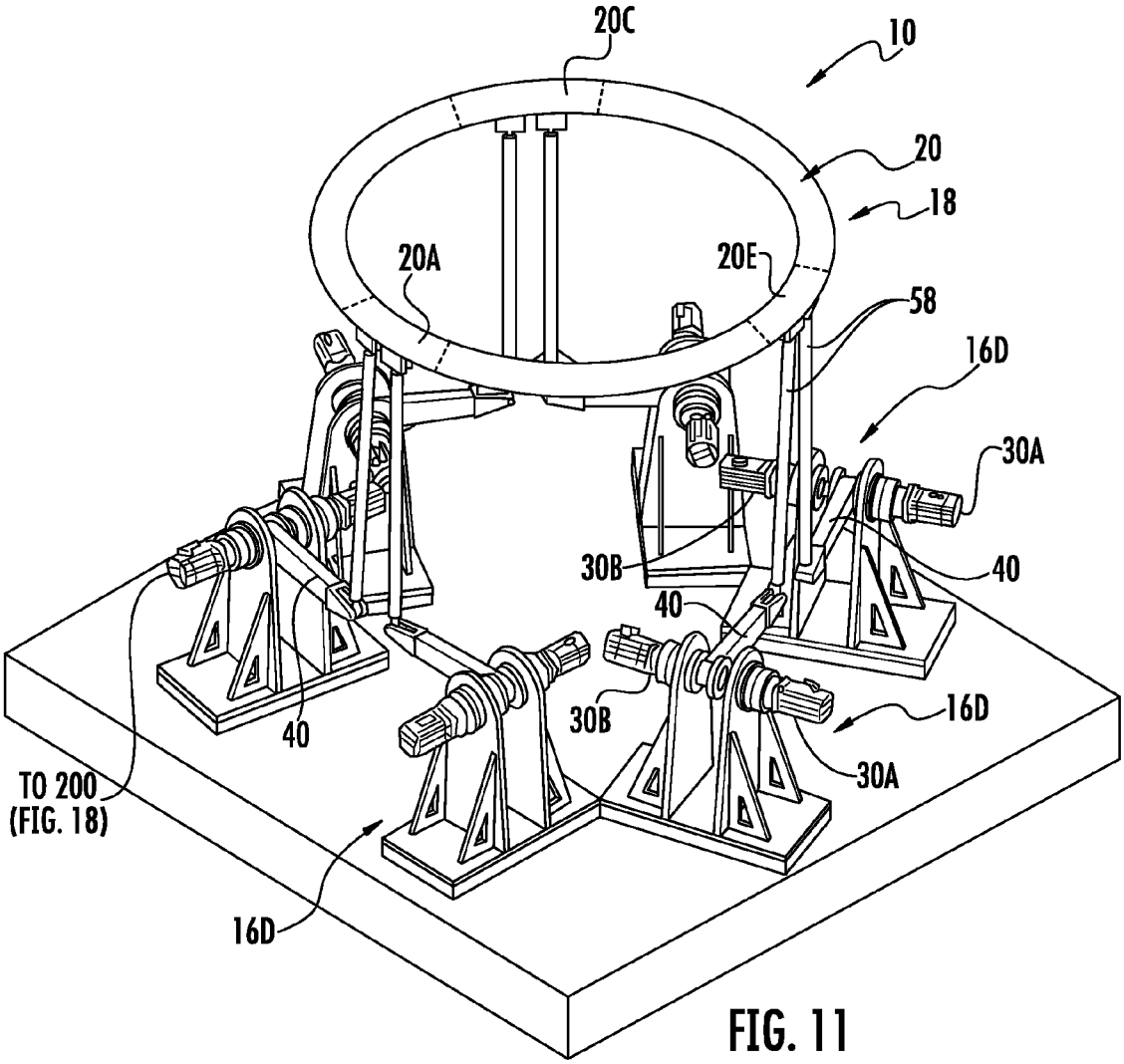
FIG. 11 is a perspective view of a Six Degree of Freedom six axis system employing dual motor/gearbox actuator assemblies.
Figure 15:
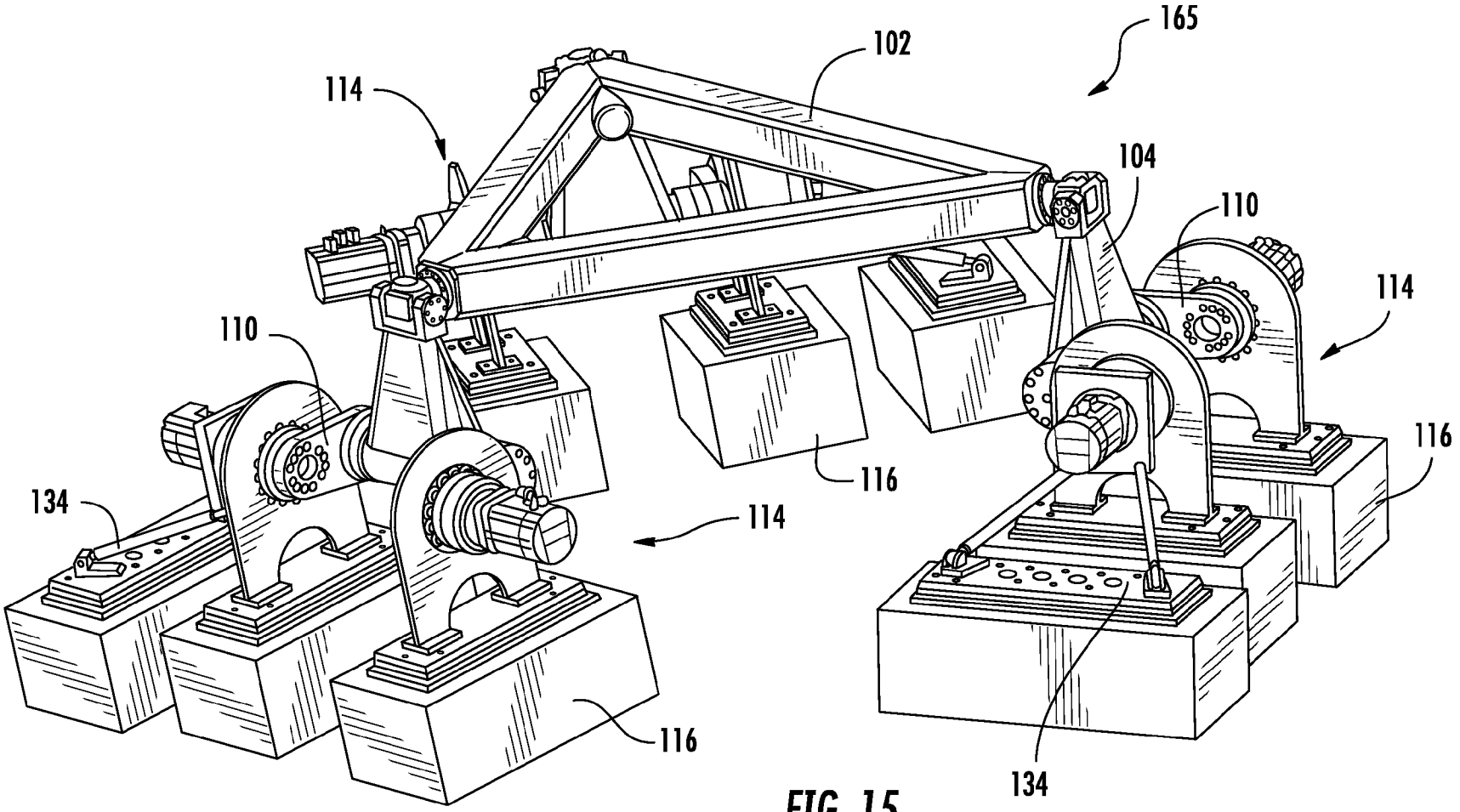
FIG. 15 (PRIOR ART)
FIGS. 15 and 16 are perspective and top plan views, respectively, of a known actuator having a six motor/gearbox assembly used in a European amusement ride as the motion system, yet not as an actuator as herein described.
Figure 16:
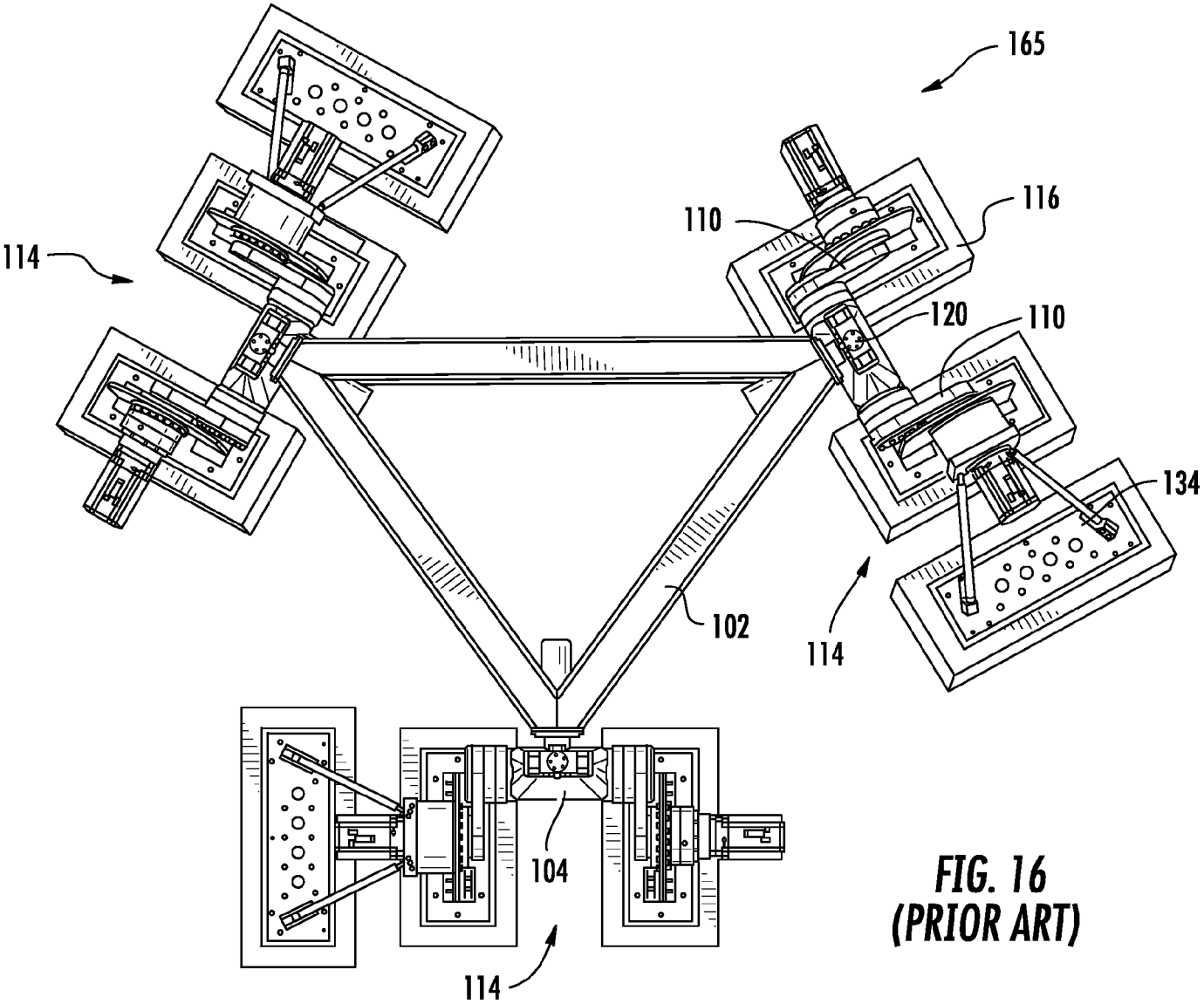
FIG. 16 (PRIOR ART)
Figure 17A:
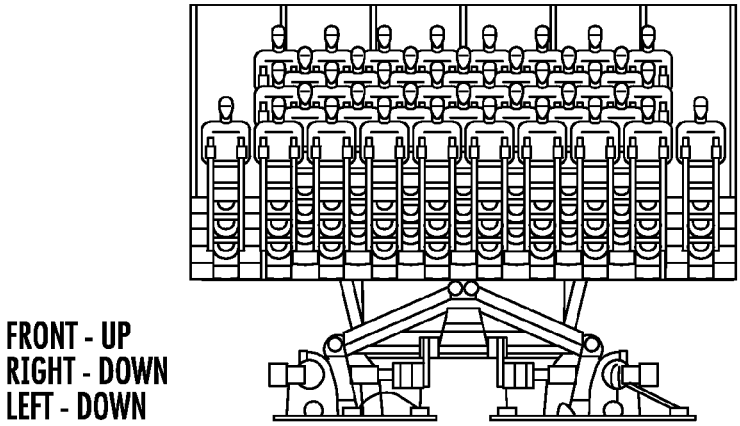
FIGS. 17A-17G are multiple views illustrating one amusement ride using the motion simulation systems herein described by way of example for various position locations within a ride.
Figure 17B:
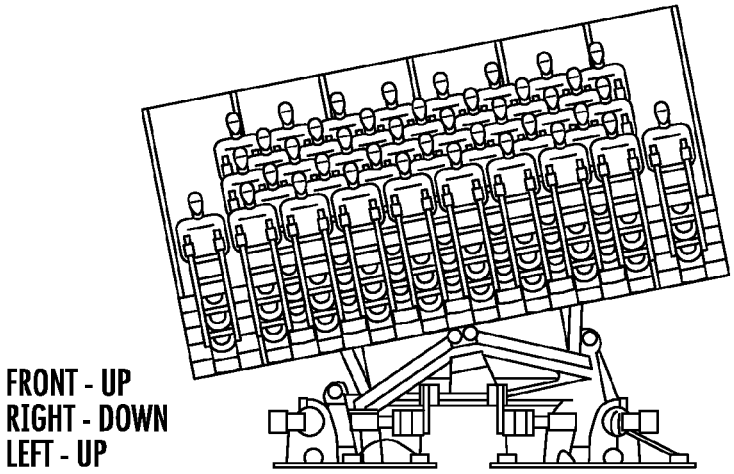
Figure 17C:
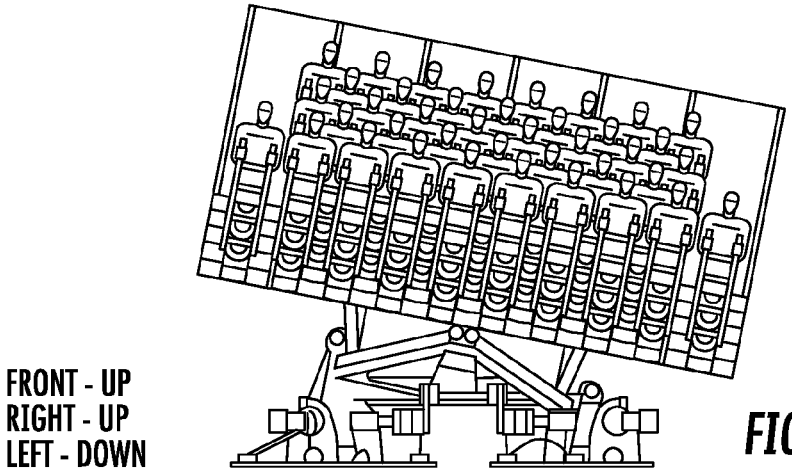
Figure 17D:
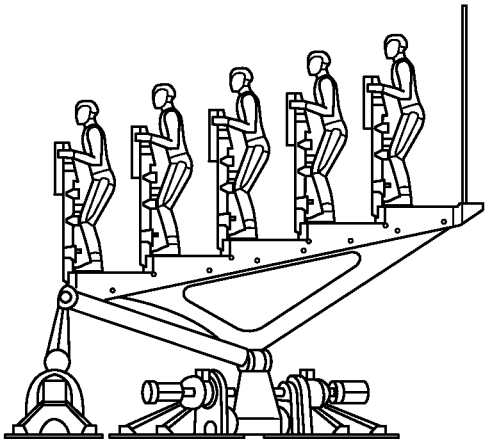
Figure 17E:
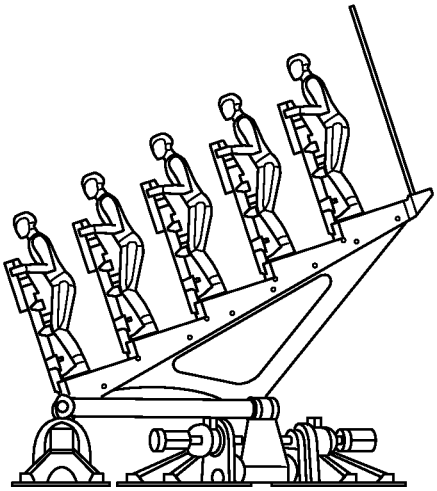
Figure 17F:
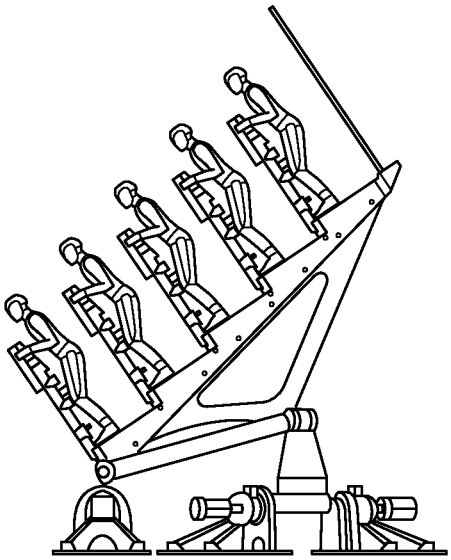
Figure 17G:
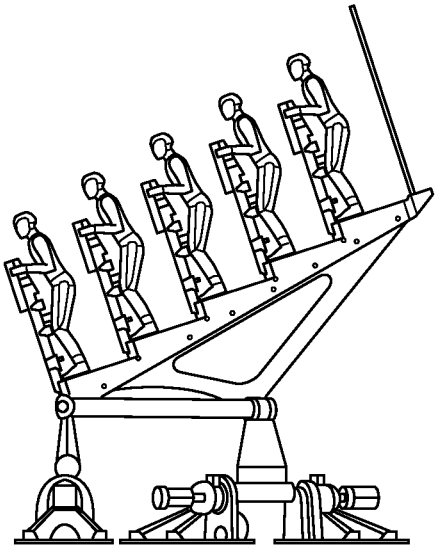

By way of further example while keeping within the teachings of the present invention, in addition to actuators being configured as the actuator 16 of FIG. 2 having a single motor/gearbox assembly 30, the actuator 16D of FIG. 11 having a dual motor/gearbox assembly 114, and the actuator 16Q of FIG. 12 having a quad gearbox assembly 16Q, an actuator having a six motor/gearbox assembly 16S, as illustrated with reference now to FIGS. 15 and 16 is desirable for relatively heavy payloads, and includes components as generally described with reference to FIG. 12, wherein the beam 102 is configured as a triangular beam and three dual motor/gearbox assemblies 114 are operably and pivotally connected to the triangular beam 102 in FIGS. 15 and 16, by way of example. Actuator supports 134 are anchored to the platform 116 for providing increased stability to the actuator 16S. By way of example, three such actuators 16S (illustrated in FIGS. 15 and 16) may be connected to the frame 18, as earlier described with reference to FIG. 13, thus substituting the actuators 16Q with the actuator 16S at the three connect locations 118. As herein illustrated with reference again to FIG. 11 for a 6 DOF system and FIGS. 15 and 16 for a 3 DOF system, dual motor/gearbox assemblies maybe employed according to the teachings of the present invention.

Figure 19A:
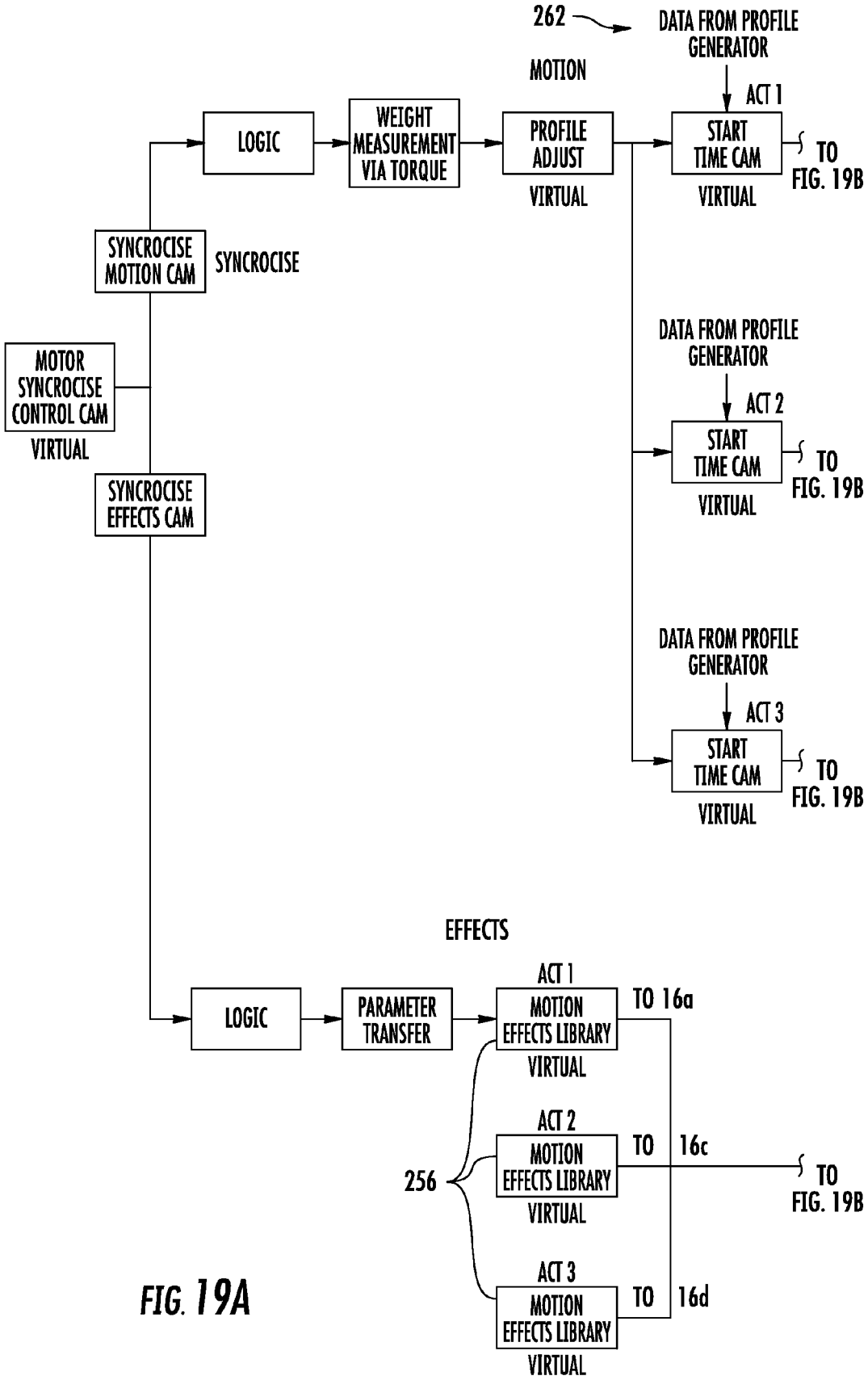
FIGS. 19A and 19B together form a flow chart of one control system illustrating process and logic functions for a three degree of motion system, according to the teachings of the present invention, and hereafter together are referred to as FIG. 19.
Figure 19B:
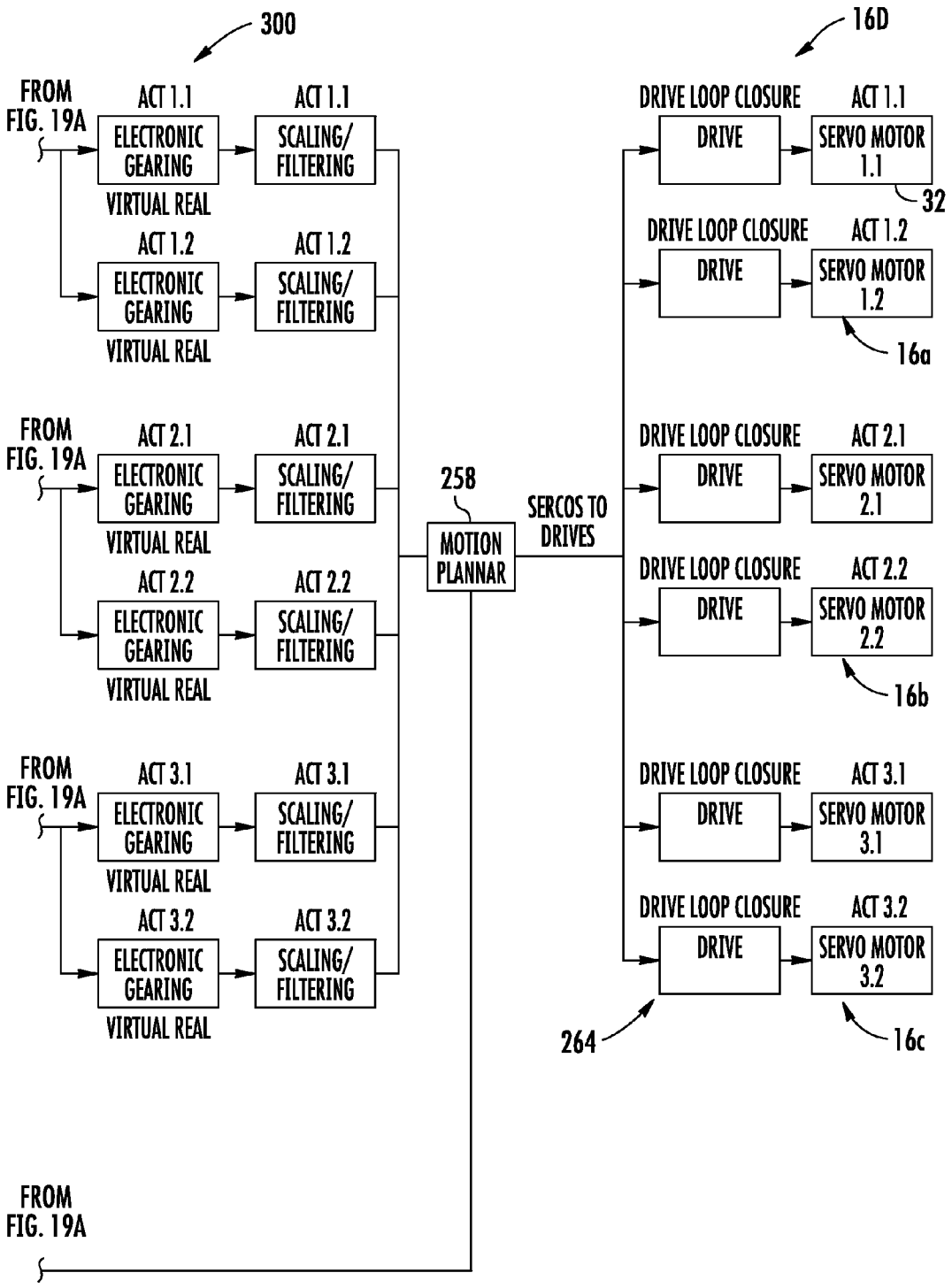

The motion systems 10, 100 herein described include control systems 200, 300, respectively, for controlling the 6 DOF and 3 DOF movements herein presented by way of example with reference to FIGS. 18 and 19, respectively. The 6 DOF control system 200 and the 3 DOF controller 300 send signals to the servomotors 32 within the actuators 16, by way of example, to drive the frame 18 operably connected to the actuators moving through desired positions, as above described. The control systems 200, 300 send signals to vary the speed and movement of the servo motors 32 and to move the actuator 17 into a desired position by moving the crank 40 through a path of rotation and the connector rod 58, or arm members 104, by way of example, through a path across multiple axes of rotation. By way of example, a desired degree of pitch is sent motion algorithms in control software operable in a processor 234 which then converts the desired pitch for an actuator position, as illustrated with reference again to FIGS. 3-9.

With continued reference to FIGS. 18 and 19, the control system 200, useful with pilot training simulators, uses a washout filter 236 as illustrated with reference to FIG. 20. The washout filter 236 is used to transform input forces and rotations of a vehicle into positions and rotations of the motion frame 18, or body to which it is attached, so that the same forces can be reproduced using the limited motion envelope of the motion frame. As above described, the control systems 200, 300 provide control of the actuators 16, 16D, 16Q, 16S for recreating acceleration, reducing the acceleration to zero while sending the control system 10 to a neutral position below a level of perception of a user of the system, by way of example. This washout filter 236 is an implementation of a classical washout filter algorithm with improvements including a forward speed based input signal shaping, extra injected position and rotation, extra injected cabin roll and/or pitch, and rotation center offset from the motion frame center when in the neutral position, as above described with reference to FIGS. 3-9. The washout filter 236 has two main streams, including high frequency accelerations and rotations (short term and washed out), and low frequency accelerations (a gravity vector).

The high frequency accelerations are responsible for producing the short frame movements and rotations within the limited frame motion envelope, while the low frequency accelerations are produced by a tilt-coordination using a "g" component when the frame 12 is titled. All input signals are first conditioned using a variable (smoothed) gain filter 242 and limited using a smoothed limiter filter 244. The high frequency accelerations and rotations are first filtered by a high-pass filter 246 and after that integrated twice to produce the desired frame high frequency position and rotation. The low frequency accelerations are also converted to a tilt coordination and filtered by a low-pass filter 248 with a limiting output speed, acceleration and onset value.

The externally injected frame position and rotation signals together with the frame or cabin roll signals are first conditioned and low-pass filtered and subsequently added to the resulting platform position and rotation. The washout filter 236 is based on a right hand coordinate system where +x is forward, +y is right and +z is down, by way example as herein presented.

The Euler filter 250 provides an Euler transformation (3D rotation algorithm) and is capable of rotating more than one vector. The input and output parameters specify arrays of vectors. The rotation angles are also specified. The HighPass2Int2 filter 246 offers an analogue 2nd order high-pass filter functionality. The output of the filter is double integrated and can be reset via a Boolean approach. The LimLowPass2 filter 248 offers an analog 2nd order low-pass filter with limiting output functionality. The output signal velocity and acceleration can also be limited. It uses an external "Gnd/Flt" input to select the limiting values to be used depending on the location within the simulated airspace: "on the ground" or "in the flight". The filter can be reset via a Boolean. The LowPass2 filter offers an analog 2nd order low-pass filter functionality.

The RCControl filter 252 provides a rotation center control algorithm to slowly move the frame 18 towards the neutral position 66, as earlier described with reference to FIGS. 3-9, when rotation takes place around another location other than the neutral position. An input and output 3D location and the location of the rotation center is used.

Figure 20:
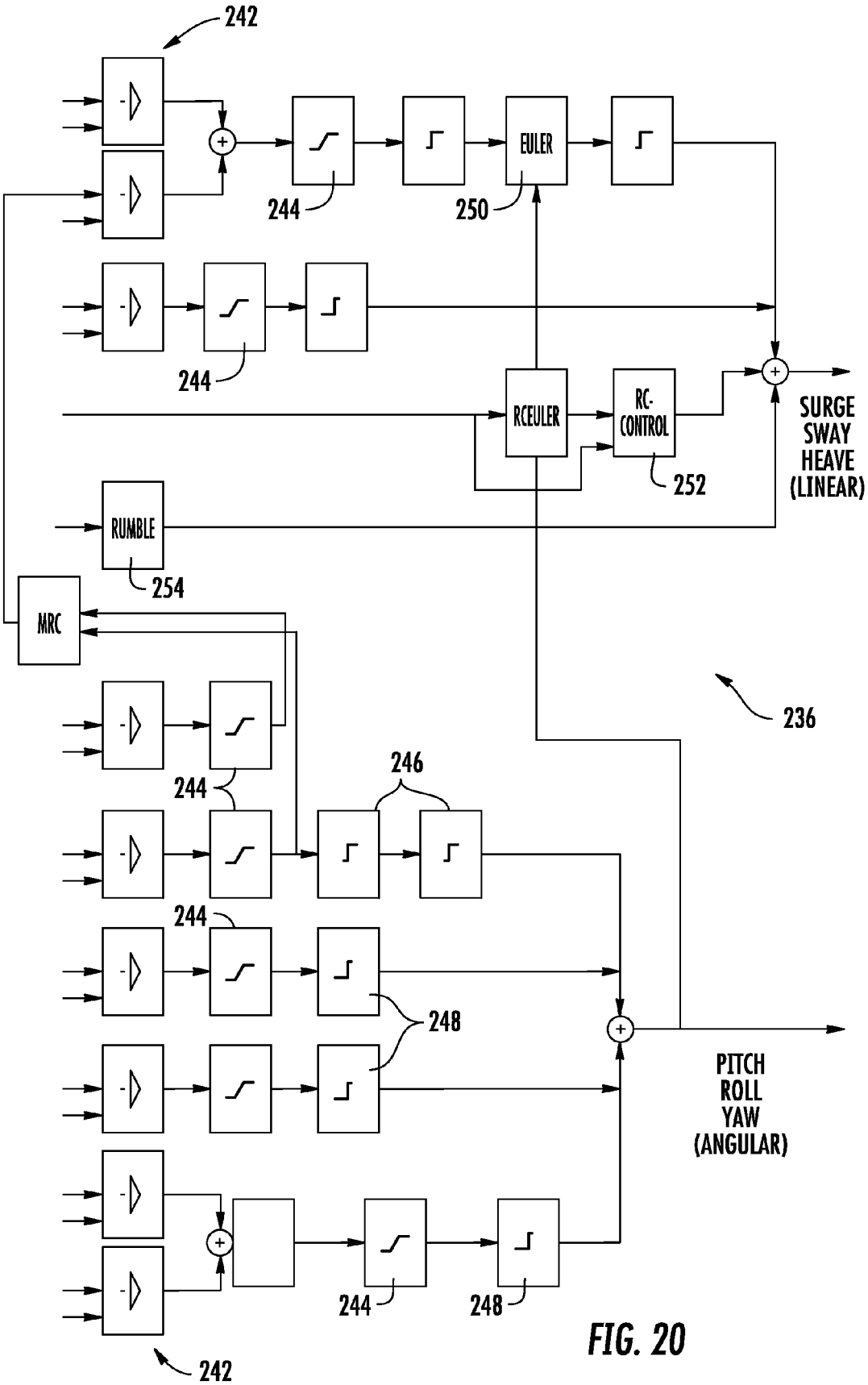
FIG. 20 is a flow chart illustrating one modular architecture of a washout algorithm according to the teachings of the present invention.

With continued reference to FIG. 20, the Rumble filter 254 provides a velocity dependent noise signal that can be used to generate a track rumble effect. Output is not reset to zero when the velocity is zero. A first order high pass filter must be used in case the output must return to zero. The frequency of this first order high pass filter can be set as desired. The SoftLimiter filter 244 offers a limiting function for an input signal, the limiting of this filter is smooth between values Lo Lin and Lower and Up Lin and Upper. The limiter lower and upper values can be set independently. The StepLimHigh-Pass1 filter 246 provides a 2nd order high-pass filter functionality with a limited step size function. The VarGain filter 242 offers a variable gain functionality. It offers three different gains. By way of example, if the input value is <X1, Gain1 is applied. If the input value is between X1 and X2, a linear interpolated gain (between Gain1 and Gain2) is applied. If the input value is between X2 and X3, Gain2 is applied. If the input value is between X3 and X4, a linear interpolated gain (between Gain2 and Gain3) is applied. If the input value is >X4, Gain3 is applied.

The motion simulation systems, herein described by way of example, have improvements in a number of areas and provide desired solutions to needs identified in the art of motions simulation, including the need for a motion simulation system with improved control and synchronization between the physical motion and response time to provide a smooth motion and experience. In addition, and as above described, desired payload requirements are met and exceeded by embodiments according to the teachings of the present invention, and are provided with a smoothness of performance for a realistic motion experience. By way of example, a payload exceeding 20 tonnes for a 3 DOF system, as herein presented by way of example, significantly exceeds payload capability for hydraulic and electric ball screw systems.

By way of example, the components above described, such as the actuators, work through all levels of axis systems including 1-axis, 2-axis, 3-axis and 6-axis systems. The frame of the motion systems provides for variable configurations which can be used for different simulator applications. For example, in a flight simulator, the cranks 40 and the connector rods 58 can be adjusted to configure the system 10 for different aircraft types. The flexibility of configuration is enabled by changing the cranks 40 and/or the connector rods 58 by having adjustable cranks and connector rods, or may easily be replaced with cranks and/or connector rods of different lengths or geometries. This flexibility is provided by the ability of the control system to be programed for different configurations and to control the movement of the actuators and platform. Such a variable system has not been accomplished to date. Embodiments of the present invention provide improvements over known systems which are geometrically fixed and cannot be adapted to suit varying geometric configurations.

The compactness of the motion systems, herein presented by way of example, enables components of the system to be desirably packaged on a single base as illustrated with reference to FIGS. 17A-17G for an amusement ride employing a three axis, as above described by way of example. The more demanding flight simulation systems can effectively use the six axis systems herein described with the improved washout filter 236.

The load carrying capability of the systems herein described by way of example goes beyond what is currently possible with known electrical motion systems, and goes beyond the largest known hydraulic system. The performance of the systems herein described goes beyond what is possible with current leading edge electrical systems which are of the ball-screw type limited in fidelity by the mechanical configuration.

By way of further example, profile generating software operable with the processor 234 has each Degree of Freedom for a motion created as a separate Motion Channel (or track). Theses may be recorded in real time via a joystick, or mouse device input. This method differs from traditional methods of recording the motion with a joystick and allows editing of the motion through an adaption of actuator positions. The controller 200, 300 directly adapts the heave, pitch and roll characteristics.

By way of further example, amusement ride film may be displayed within the processor software application which enables a desirable accuracy and an accurate development of the ride profile. Real time recording for each channel is implicitly synchronized to each frame of the movie, so that each point in the motion profile matches the ride film perfectly (literally frame by frame). Typically, the approach is to synchronize using a time line which can drift over time. Each Recorded Motion Channel is displayed as a waveform within a scaled display, and can be viewed at different resolutions. This enables the ride profile to be modified frame by frame. This is an improvement over prior methods where the whole profile has to be re-done if any changes to a motion profile are required which typically is time consuming and expensive for known systems.

A simulation profile can be adjusted through phase shift, and/or amplitude and frequency modifications. One of the features of the controller is that a motion profile can be changed free hand by a developer with mouse using Drag and Drop techniques. An inverse kinematic algorithm is built in (off-line real time transformation of heave, pitch and roll converting back to absolute radial movements of the motors—includes complex time domain filtering to represent the real world). Position and acceleration limits are built in with real time methodology.

A joystick sensitivity algorithm is built in, which can simulate different vehicle/platform properties (e.g. various aircraft types; helicopter types; land vehicles types).

With reference again to FIGS. 18 and 19, special effects algorithms are embedded within the controller 200, 300. A motions effects library 256 may be dedicated to each actuator 16*a*, 16*b*, 16*c*, by way of example for a 3 DOF system, as illustrated with refereed to FIG. 17, or may be employed as a single library communicating with a motion planner 258, as illustrated with referee to FIG. 18. This significantly improves control and enables a nesting, (also known as a combining or stacking) of effects in real time. Motion effects are superimposed real time onto the motion profile with frame by frame synchronization. Therefore effects can also be controlled with frame rate accuracy. Frequency and amplitude are fully adjustable at any location in the profile. Multiple effects can be nested (stacked) without loss of profile position (i.e. there is no drifting over time). Easily created and edited software tools are provided to make it user friendly and avoid the need to make changes at source code level which can only be done by a specialist.

Multiple synchronization algorithms are embedded within the controller to allow a desirable synchronization of special motion effects (vibrations) and external events (wind, scent, water, etc.). Each synchronization track can be set at any multiple of the frame rate. This system includes passive and active control. This is an improvement over the traditional systems that are time code based which can drift over time. The synchronization tracks can be nested and started from an external signal, other tracks, or internal controller generated events, by way of example. As a result, absolute synchronization based on the position of the motors results. The traditional approach was to synchronize through a series of time coded triggers. In the amusement industry, the traditional methods resulted in problems of motion and film synchronization which often needs to be reset one or more times per day. Otherwise the mismatch has serious potential to trigger motion sickness.

By way of example with reference again to the 3 DOF system of FIG. 18, each pair of motors 32 is synchronized in a position mode. Typical systems were configured with one motor controlled by position and the second motor controlled through torque matching (or current following). As a result of the teachings of the present invention, embodiments of the present invention provide an absolute positioning of the synchronized motors. By way of contrast, typical torque matching techniques (or current following methods) do not take into account variations in production within and between the motor/gearbox assemblies. The motors can be controlled to synchronize their position on an absolute position of rotation. For example, if motor pairs are used, the two motors can be controlled to adjust one motor to match the position of the other motor. With reference again to the embodiment of FIG. 11, by way of example, each actuator 16D has the motors 32 in a motor pair running in opposite directions. This applies to any multi axis system using dual motor/gearbox assemblies Synchronization is achieved via multiple virtual axes and electronic gearing, with an internal correction loop within a drive loop closure 264. This enables the nesting of effects described above.

The ability to synchronize the motor pairs within the actuator 16D allows for the systems 10, 100 to handle higher payloads. The system 10 can handle payloads of at least 20 tonnes for six axis systems employing a single motor per actuator, and at least one and one half times this payload when employing motor pairs, by way of example.

It should be noted that while each actuator can run with one pair or two pairs of motor/gearbox assemblies, systems can also operate with a single motor/gearbox assembly. The number and configuration of the motor/gearbox assemblies is primarily determined by the load and acceleration requirements.

By way of example for the control systems 200, 300 herein described by way of example with reference to FIGS. 18 and 19, a motion profile is run as "Interpolated Cam Segments" with constant position monitoring. This approach, with milliseconds updating, increases positional accuracy and maximizes ride smoothness. Master cam timing can be adjusted as required. The control system includes complex filtering to enable the ride profile to be managed and/or modified on the fly. A Cam Profile form a cam profile generator 262 is linked only to virtual (multiple) axes, as illustrated with reference to FIG. 19. Further, interpolation in the integral drive loop closure 264 is achieved within a nanosecond range while providing a smoothness of motion especially when including washout motion which has not been achieved in the art. A capability of multiple correction cams to adjust master profile as required facilitates real time adjustments.

The embodiments of the systems herein described operate with reduced power consumption as it can operate as a regenerative power system. This is enabled by the use of servos connected to a common DC Bus which is fed via the DC Regenerative Power Supplies and reactors. The regenerative power works by using decelerating drives feeding power to accelerating drives, hence reducing overall power intake. The system regenerates power throughout the whole ride cycle whenever a drive is in a decelerating mode, regardless of whether it is going up or down. This new teaching minimizes the overall power consumption. During motion where net deceleration is greater than net accelerations plus losses, energy may be shared with other actuators cooperating therewith, or stored locally in a capacitor arrangement or returned to the grid (utility supply) at the correct phase, voltage and frequency. This approach has eliminated the need for breaking resistors and all excess energy can be returned to the grid (utility supply). This results in the minimal use of power. Power consumption has been found to be less than one half the power consumption of a traditional ball-screw system with a counterbalance which may be pneumatic, less than ⅓ of the power consumption of the ball-screw system without a counter balance system, and less than 15% of the power of an equivalent hydraulic system, thus about an 85% power savings when compared to an equivalent hydraulic system.

By way of supporting example, embodiments of the invention including a 6-axis motion system has been designed, engineered, built and tested, including a proof of concept development with a 200 kg (454 lb.) payload and a pre-production system of 2 tonne (4,410 lb.) payload system. The 6-axis motion system stems from a 3-axis motion system which was developed in 2010/2011 for payloads up to 9 tonnes (19,850 lb.). Further, a 33,075 lb. (15 tonne) system has been designed and engineered to meet stringent flight simulation requirements. The simulation system includes a cam mechanism.

Improvements and benefits over existing traditional hexapod electric ball-screw motion systems include the configuration of the cam mechanism, especially when coupled with high end servo-motors, drives and planetary gearboxes, results in zero mechanical backlash as planet gears remain in contact with the output shaft teeth throughout the full range of motion. By way of example, the system can be readily configured to a different configuration within a few hours by replacing cranks and connector rods with those of differing lengths to suit various aircraft platforms (within physical constraints). This will also allow the same motors and gearboxes to provide a greater range of excursions when coupled to a smaller cabin of a flight simulator. The classic Hexapod system has no such configuration flexibility and a separate motion system is required for each platform type. The configuration is not constrained to current load carrying and acceleration performance of the existing Hexapod systems.

A 24 tonne payload 3-axis motion system is currently being developed according to the teachings of the present invention for the leisure industry. A 9 tonne payload 3-axis motion system and a 2 tonne 6-axis motion system are currently being tested.

Additional benefits and features include improved Inverse Kinematic Algorithm within real time "Motion Control Software" hosted in a Windows 7 Environment with a Washout Algorithm where appropriate to convert from positions in each of the six degrees of freedom into absolute radial servo motor positions. Position and acceleration limits are integrated into the motion control software. Multiple effects can be nested (stacked) to ensure no loss of position over time when effects are superimposed.

A user friendly suite of software tools enables program parameters to be changed without the need for a specialist programmer to make changes at source code level. A desirable motor synchronization is provided when double motors or quad motors are required to meet payload load and performance specifications. Synchronization is achieved through the use of virtual axes, electronic gearing and real time internal correction loops running at 1 millisecond intervals, by way of example.

Full regenerative energy capability can be included so that any decelerating actuator works in a fully regenerative mode. This provides typical powers which are in the region of one-third of a non-counterbalanced ball-screw system and one-half of a pneumatically counterbalanced ball-screw system. The reduction in thermal loading significantly extends the life of all electrical and electronic components minimizing maintenance costs and maximizing availability. The system also has the optional ability to return excess power to the utility grid when internal regeneration exceeds system needs. This is not possible with hydraulic and ball-screw type drive systems.

The system uses an industrialized sophisticated motion controller and high quality servo drives to generate and control complex motion profiles. The motion controller receives data from the Motion PC via User Datagram Protocol (UDP). After processing, the data is sent to the servo drives using a 1 msec Loop Closure (Data Send and Receive rate) while the internal drive loop closure is within the nano-second range. High Data update rates coupled with advanced "Real Time, Dynamically Responsive" motion control algorithms allows the creation of desirably smooth and accurate simulator motion beyond that provided by known motion simulator systems.

Motion effect algorithms allow complex vibrations to be superimposed onto the motion (directly imparted through the drive system) up to the saturation level of the whole system. Vibrational frequencies exceeding 100 Hz are achieved. Resonant frequencies can easily be identified and avoided. In contrast, electric ball-screw and hydraulic systems have limited vibrational capabilities in the region of 30-35 Hz. In addition, a secondary vibration system has to be installed where higher frequencies are required.

One desirable characteristic of the motion systems herein presented includes mass and center of mass determinations during operation of the system. By way of example, when the system moves to the neutral position in the amusement industry applications, the system is able to measure the motor torques and currents of each motor. Through triangulation the mass and the center of mass of the system can be determined. This information may then be used so that, regardless of a variable guest mass and a distribution of the variable guest mass, a ride acceleration profile can be adjusted instantaneously so that the guests always experience and feel the same motion, and hence the same ride experience regardless of the guest mass and guest mass distribution. This mechanism may also be used in any type of simulator to ensure that the guest experience is identical regardless of the mass of the guest in each vehicle.

Although the invention has been described relative to various selected embodiments herein presented by way of example, there are numerous variations and modifications that will be readily apparent to those skilled in the art in light of the above teachings. It is therefore to be understood that, within the scope of the claims hereto attached and supported by this specification, the invention may be practiced other than as specifically described.

That which is claimed is:

1. A motion simulation system comprising:

a frame;

at least one connector rod having opposing proximal and distal ends thereon, wherein the distal end of the at least one connector rod is rotatably connected to the frame;

at least one actuator including:

a single motor/gearbox assembly having a servomotor operable with a planetary gearbox and shaft driven thereby;

a crank arm having a proximal end fixedly attached to the shaft for rotation thereby, and a distal end rotatably connected to the proximal end of the single connector rod;

a base; and a support having a proximal end affixed to the base and an opposing distal end affixed to the motor/gearbox assembly for fixedly attaching the motor/gearbox assembly in spaced relation to the base, wherein the support comprises a first support in spaced relation to a second support, wherein each of the first and second supports extends generally upwardly from the base, wherein the single motor/gearbox assembly is carried by the first support and a distal end of the shaft is rotatably connected to the second support for rigidly aligning an axis of rotation of the shaft, and wherein the crank arm is rotatable between the first and second supports; and a controller operable with the at least one actuator for providing an electric signal to each of the servomotors for providing a preselected motion to the at least one connector rod and thus the frame, wherein the control system directs input forces and rotational movements into positions of the frame.

2. The motion simulation system according to claim 1, wherein one to six single-motor/gearbox actuators are pivotally connected to the frame and operable for movement thereof from one to six degrees of freedom movement.

3. The motion simulation system according to claim 1, further comprising a platform, wherein the base comprises a plurality of bases affixed to the platform.

4. The motion simulation system according to claim 1, wherein the at least one actuator further comprises a second motor/gearbox assembly, the first motor/gearbox assembly carried by the first support and the second motor/gearbox assembly carried by the second support, both first and second motor/gearbox assemblies cooperating through the shaft to drive the crank arm as a two motor/gearbox actuator.

5. The motion simulation system according to claim 4, wherein one to six two-motor/gearbox actuators are pivotally connected to the frame and operable for movement thereof from one to six degrees of freedom movement.

6. The motion simulation system according to claim 4, further comprising a platform, wherein the base comprises a plurality of bases affixed to the platform.

7. The motion simulation system according to claim 1, wherein the connector rod comprises a plurality of connector rods, wherein the frame comprises a plurality of frame sections having at least one connector rod pivotally attached thereto, and wherein each of the plurality of frame sections is dimensioned for attachment to a body for transferring movement thereto.

8. The motion simulation system according to claim 1, wherein the controller is operable with a processor identifying multiple degrees of freedom for communicating with the servo motor in the at least one actuator, and wherein movement associated with each degree of freedom is processed with a separate motion channel.

9. The motion simulation system according to claim 8, wherein the processor includes at least one synchronization algorithm for synchronization of special motion effects and external event effects.

10. The motion simulation system according to claim 1, wherein the controller is operable with the actuator for generating power during deceleration movements of the actuator for use during acceleration thereof.

11. The motion simulation system according to claim 10, wherein the processor monitors motion, and when a net deceleration is greater than a net acceleration plus operational losses, transfers energy to a utility supply at selected phase, voltage and frequency values of the servo motor, thus optimizing power consumption provided by the utility supply.

12. A motion simulation system comprising:

a frame;

at least one connector rod having opposing proximal and distal ends thereon, wherein the distal end of the at least one connector rod is rotatably connected to the frame;

at least one actuator operable with the proximal end of the at least one connector, the at least one actuator comprising a four-motor/gearbox actuator including:

a base;

a first actuator subassembly including a first support in spaced relation to a second support, wherein each of the first and second supports extends generally upwardly from the base, and wherein the motor/gearbox assembly comprises first and second motor/gearbox assemblies, the first motor/gearbox assembly carried by the first support and the second motor/gearbox assembly carried by the second support, the crank arm comprising first and second crank arms;

a first arm member having a proximal end thereof rotatably connected to a distal end of the first crank arm;

a second actuator subassembly including a third support in spaced relation to a fourth support, wherein each of the third and fourth supports extends generally upwardly from the base, and wherein the motor/gearbox assembly comprises third and fourth motor/gearbox assemblies, the third motor/gearbox assembly carried by the third support and the fourth motor/gearbox assembly carried by the fourth support;

a second arm member having a proximal end thereof rotatably connected to a distal end of the second crank arm; and a beam rotatably connected to distal ends of the first and second arm members at spaced locations thereon, wherein the beam is rotatably connected to the frame; and a controller operable with the at least one actuator for providing an electric signal to each of the servomotors for providing a preselected motion to the at least one connector rod and thus the frame, wherein the control system directs input forces and rotational movements into positions of the frame.

13. The motion simulation system according to claim 12, wherein the four-motor/gearbox actuator comprises three four-motor/gearbox actuators pivotally connected to the frame and operable for movement thereof from one to three degrees of freedom movement.

14. The motion simulation system according to claim 12, further comprising a platform, wherein the base comprises a plurality of bases affixed to the platform.

15. A motion simulation system comprising:

a frame;

at least one connector rod having opposing proximal and distal ends thereon, wherein the distal end of the at least one connector rod is rotatably connected to the frame;

at least one actuator operable with the proximal end of the at least one connector, the at least one actuator comprising a four-motor/gearbox actuator including:

a base;

a first actuator subassembly including a first support in spaced relation to a second support, wherein each of the first and second supports extends generally upwardly from the base, and wherein the motor/gearbox assembly comprises first and second motor/gearbox assemblies, the first motor/gearbox assembly carried by the first support and the second motor/gearbox assembly carried by the second support, the crank arm comprising first and second crank arms;

a first arm member having a proximal end thereof rotatably connected to distal ends of both the first and second crank arms;

a second actuator subassembly including a second support in spaced relation to a third support, wherein each of the second and third supports extends generally upwardly from the base, and wherein the motor/gearbox assembly comprises second and third motor/gearbox assemblies, the second motor/gearbox assembly carried by the second support and the third motor/gearbox assembly carried by the third support, the crank arm comprising third and fourth crank arms;

a second arm member having a proximal end thereof rotatably connected to distal ends of both the first and second crank arms;

a third actuator subassembly including a fifth support in spaced relation to a sixth support, wherein each of the fifth and sixth supports extends generally upwardly from the base, and wherein the motor/gearbox assembly comprises fifth and sixth motor/gearbox assemblies, the fifth motor/gearbox assembly carried by the fifth support and the sixth motor/gearbox assembly carried by the sixth support, the crank arm comprising fifth and sixth crank arms;

a third arm member having a proximal end thereof rotatably connected to distal ends of both the fifth and sixth crank arms; and a beam rotatably connected to distal ends of each of the first, second and third arm members at spaced locations thereon; and a controller operable with the at least one actuator for providing an electric signal to each of the servomotors for providing a preselected motion to the at least one connector rod and thus the frame, wherein the control system directs input forces and rotational movements into positions of the frame.

16. The motion simulation system according to claim 15, wherein the beam is connected to the frame for movement thereof resulting from movement of the first, second and third arm members.

17. The motion simulation system according to claim 15, further comprising a platform, wherein the base comprises a plurality of bases affixed to the platform.

18. The motion simulation system according to claim 17, further comprising an actuator support assembly anchored to the platform and secured to at least one support for providing increased stability to the actuator.

* * * * *